US010448679B1

(12) United States Patent
Roddis et al.

(10) Patent No.: US 10,448,679 B1
(45) Date of Patent: Oct. 22, 2019

(54) HIGH IMPACT AND HIGH SUPPORT BRAS

(71) Applicant: The Gap, Inc., Albuquerque, NM (US)

(72) Inventors: Brett Roddis, Berkeley, CA (US); Melissa Lawrence, San Francisco, CA (US); John Kelly, San Francisco, CA (US); Zachary Michael Goldberg-Poch, San Francisco, CA (US); Philip Isaac Oaks, Berkeley, CA (US); Carolina Isabel Rodriguez, Berkeley, CA (US); H. William Smith, IV, Mill Valley, CA (US); Daniel Ross Tachibana, San Francisco, CA (US)

(73) Assignee: The Gap, Inc., San Francisco, CA (US)

( * ) Notice: Subject to any disclaimer, the term of this patent is extended or adjusted under 35 U.S.C. 154(b) by 0 days.

(21) Appl. No.: 16/297,473

(22) Filed: Mar. 8, 2019

Related U.S. Application Data

(60) Provisional application No. 62/731,592, filed on Sep. 14, 2018.

(51) Int. Cl.
*A41C 3/12* (2006.01)
*A41C 5/00* (2006.01)
*A41C 3/00* (2006.01)

(52) U.S. Cl.
CPC ..... *A41C 3/12* (2013.01); *A41C 3/0057* (2013.01); *A41C 5/005* (2013.01)

(58) Field of Classification Search
CPC ..... A41C 3/0057; A41C 3/12
USPC ..... 450/39, 57
See application file for complete search history.

(56) References Cited

U.S. PATENT DOCUMENTS 4,884,323 A 12/1989 Provost et al.
5,951,367 A * 9/1999 Hsu ..... A41C 3/144 2/267
6,306,006 B1 * 10/2001 Cheng ..... A41C 3/10 2/267
7,442,110 B2 * 10/2008 Gaudet ..... A41C 3/0057 450/39

(Continued)

OTHER PUBLICATIONS

Allen, et al., "Auxetic Foams for Sport Safety Applications," Procedia Engineering, 112:104-109 (2015).

(Continued)

*Primary Examiner* — Gloria M Hale
(74) *Attorney, Agent, or Firm* — Morgan, Lewis & Bockius LLP

(57) ABSTRACT

Bras for high impact, high support activities are provided. A bra comprises a band that wraps around a torso. The band includes first and second cup regions, and a channel that runs below the collective cup regions. A gore is formed above the channel and between the respective cup regions, adjoining the respective cup regions. A molded cradle is fitted into the channel. For each cup region, a tessellated encapsulating bra cup is fitted therein. Each tessellated encapsulating bra cup includes a plurality of tiles. Respective tiles in the plurality of tiles that are further away from the cradle are larger in size than respective tiles in the plurality of tiles that are closer to the cradle. Each tessellated encapsulating bra cup has a generally concave first inner face and a generally convex first outer face. The tessellated encapsulating bra cups collectively contribute cantilevered support to the bra.

20 Claims, 24 Drawing Sheets

(56) References Cited

U.S. PATENT DOCUMENTS

| | | | | |
|---|---|---|---|---|
| 7,455,567 | B2 * | 11/2008 | Bentham | A41B 17/00 450/54 |
| 8,915,764 | B2 * | 12/2014 | Scott | A41C 3/0021 450/53 |
| D829,128 | S | 9/2018 | Webb | |
| 10,070,670 | B2 | 9/2018 | Eilemberg | |
| 10,092,043 | B2 | 10/2018 | Zhang | |
| 10,104,918 | B2 | 10/2018 | Hurd | |
| 10,104,919 | B2 | 10/2018 | Perl | |
| 10,111,472 | B2 | 10/2018 | Tempesta | |
| 10,123,575 | B2 | 11/2018 | Funk-Danielson et al. | |
| D835,882 | S | 12/2018 | Robertson | |
| D836,290 | S | 12/2018 | Steele | |
| D836,291 | S | 12/2018 | Robertson | |
| 10,179,960 | B2 | 1/2019 | Diaz et al. | |
| 10,182,600 | B2 | 1/2019 | Getter et al. | |
| 10,201,192 | B1 | 2/2019 | Lott | |
| 2008/0011021 | A1 * | 1/2008 | Starbuck | D04B 21/06 66/170 |
| 2008/0032598 | A1 * | 2/2008 | Bentham | A41B 17/00 450/39 |

OTHER PUBLICATIONS

Chan, N. and Evans, K. E., "Fabrication methods for auxetic foams," Journal of Materials Science, 32:5945-5953 (1997).

Haynes, C., "Understanding the Parts of a Bra," Craftsy & Sympoz Inc., 7 pages (Feb. 28, 2017), downloaded from https://www.craftsy.com/sewing/article/parts-of-a-bra/ on Jul. 31, 2018.

Hensinger, et al., "Pamgen, a Library for Parallel Generation of Simple Finite Element Meshes," Sand Report, Sandia National Laboratories, pp. 3-86 (2008).

Liu, et al., "General Planar Quadrilateral Mesh Design Using Conjugate Direction Field," ACM Transactions on Graphics, 30(6):140: 9 pages (Dec. 2011).

Nanofront® SDS Safety Data Sheet, "Polyethylene terephthalate," Teijin Limited, pp. 1-4 (Jan. 22, 2016).

Sadek, et al., "Effect of Lycra Extension Percent on Single Jersey Knitted Fabric Properties," Journal of Engineered Fibers and Fabrics, 7(2):11-16 (2012).

Singha, K., "Analysis of Spandex/Cotton Elastomeric Properties: Spinning and Applications," International Journal of Composite Materials, 2(2):11-16 (2012).

Sun, et al., "Mechanical and Electrical Properties of Spandex Reinforced GMWNT/epoxy Shape Memory Composites," Proc.of SPIE, 8342:A-1-A-6, downloaded from http://proceedings.spiedigitallibrary.org/ on Mar. 15, 2016.

Zupin, Z. and Krste, D., "Mechanical Properties of Fabrics from Cotton and Biodegradable Yarns Bamboo, SPF, PLA in Weft," Woven Fabric Engineering, Polona Dobnik Dubrovski (Ed.), Sciyo:25-46 (2010).

* cited by examiner

100

HIGH IMPACT AND HIGH SUPPORT BRAS

CROSS REFERENCE TO RELATED APPLICATION

This Application claims priority to U.S. Provisional Patent Application No. 62/731,592, entitled "High Impact and High Support Bras," filed Sep. 14, 2018.

TECHNICAL FIELD

This specification describes bras that provide a high degree of support during activities that are associated with high impact.

BACKGROUND

Surveys have indicated that bras have a number of drawbacks, chief among them the difficulty in putting them on and off Another difficulty highlighted in surveys is that they are often too tight or too loose in the chest band. Still another drawback with bras according to surveys is the discomfort experienced due to the weight of the bra pulling on the shoulders and the neck, which can cause cutting into skin. Still another drawback with bras according to surveys is nipple show-through. Moreover, there continues to be a need for improved support and comfort.

Addressing these deficiencies is complicated by the fact that many women have breast asymmetry and that the breast does not contain muscle but rather is comprised of fat and glandular tissue. Addressing these deficiencies is further complicated by the fact that breast movement is complex, with the breast being capable of moving along three different orthogonal axes depending on activity, and the way in which the weight of each breast is distributed differently.

Given the above-background, what is needed in the art are improved bras to overcome the above identified deficiencies. Such improvements will have the benefit of empowering women. That is, achieving a central goal of enabling every woman to be confident and feel comfortable without limits or distraction.

SUMMARY

The present disclosure addresses the above-identified deficiencies. In the present disclosure bras that provide cantilevered support, as opposed to relying solely on suspension support, are provided. In some embodiments this cantilevered support is provided by encapsulation of breasts, which separates the breasts and treats them as two separate masses, as opposed to compression of the breasts, which compresses the breasts into a single mass and thereby treats the breast, from a support perspective, as this single mass. Moreover, in some embodiments, the presently disclosed bras provide for a reduction in acceleration. In such embodiments, all breast movement is not hindered. However, such embodiments of the present disclosure are able to reduce breast acceleration resulting in a minimization of the amount of pain that is experienced when wearing the disclosed bras.

A bra of the present disclosure includes a band that wraps around a torso of a wearer. The band includes a back portion, a first underarm portion, a second underarm portion, and a front portion. The front portion is connected to the back portion through both the first underarm portion and the second underarm portion. Additionally, the band includes a first cup region and a second cup region. A channel runs below the first cup region and the second cup region, and the channel is formed between an inner fabric and an outer fabric (e.g., an inner fabric and an outer fabric of the band). A gore is formed above the channel and between the first cup region and the second cup region, which adjoins the first cup region and the second cup region together. Moreover, a molded cradle, which has at least a first curvature with respect to a first plane, is fitted into the channel. Each tessellated encapsulating bra cup includes a plurality of tiles, and is fitted into the corresponding cup region. Respective tiles in the plurality of tiles that are further away from the molded cradle, that is further away from a bottom portion of the band, are larger in size than respective tiles in the plurality of tiles that are closer to the molded cradle, or closer to the bottom portion of the band. This, in itself, provides for a novel basis for cantilevered support. Furthermore, each tessellated encapsulating bra cup has a generally concave inner face and a generally convex outer face. Altogether, the tessellated encapsulating bra cups collectively contribute unparalleled novel cantilevered support to the bra.

In some embodiments, the first cup region, the gore, and the second cup region collectively define a neckline on the front portion of the band.

In some embodiments, each respective tile in at least a first subset of the plurality of tiles of each tessellated cup is hollowed.

In some embodiments, each respective tile in at least a first subset of the plurality of tiles of each tessellated encapsulated bra cup is solid.

In some embodiments, each tessellated encapsulating bra cup includes a first outer boundary. Accordingly, each respective tile in the plurality of tiles of the corresponding tessellated encapsulated bra cup that is contacting the first outer boundary is triangular in shape. Each respective tile in the plurality of tiles of the corresponding tessellated encapsulated bra cup that is not contacting the first outer boundary is approximately quadrilateral in shape.

In some embodiments, each respective tile in the plurality of tiles of the corresponding tessellated encapsulated bra cup that is contacting the first outer boundary is one of triangular, quadrilateral, or pentagonal in shape. Moreover, each respective tile in the plurality of tiles of the corresponding tessellated encapsulated bra cup that is not contacting the first outer boundary is approximately quadrilateral in shape.

In some embodiments, the bra is a pull-on bra. In alternative embodiments, the band is interrupted by a clasp, where the clasp is characterized by an unhitched state in which the band is opened for removal or placement of the bra on a torso. Inasmuch, the clasp is also characterized by a hitched state in which the bra is affixed to the torso.

In some embodiments, each tessellated encapsulating bra cup is formed by liquid lycra painting. In some such embodiments, the liquid lycra includes between 40 and 95 percent weight volume (w/v) water and between 5-50 percent w/v polyurethane urea. In some embodiments, the liquid lycra includes between 40 and 95 percent weight volume (w/v) water and between 5-60 percent w/v polyurethane urea.

In some embodiments, each tessellated encapsulating bra cup includes a thermoplastic rubber (TPR). In some embodiments, the thermoplastic rubber is a styrenic block copolymer, a thermoplastic polyolefinelastomer, a thermoplastic vulcanizate, a thermoplastic polyurethane, a thermoplastic copolyester, or a thermoplastic polyamide.

In some embodiments, each tessellated encapsulating bra cup includes a compressible auxetic polymeric foam having a negative Poisson's ratio. In some such embodiments, the compressible auxetic polymeric foam is formed by undergoing a compression and heat treatment process of a thermoformable polymeric foam.

In some embodiments, the thermoformable polymeric foam is polyurethane foam. In some embodiments, the thermoformable polymeric foam is an open-cell foam. In some embodiments, the open-cell foam is a reticulated open-cell polyurethane. In some such embodiments, the reticulated open-cell polyurethane has between 20 and 100 pores in-$^{1}$ (ppi). In some embodiments, the reticulated open-cell polyurethane has between 10 and 100 pores in-$^{1}$. Alternatively, in some embodiments, the reticulated open-cell polyurethane has a density of 20-35 kg/m$^{3}$, a density of 26-32 kg/m$^{3}$, a density of 26-29 kg/m$^{3}$, or a density of 15-50 kg/m$^{3}$.

In some embodiments, the thermoformable polymeric foam is a closed-cell foam.

In some embodiments, the negative Poisson's ratio (v) referenced above is between −0.05 and −0.75. In some embodiments, the negative Poisson's ratio is between −0.05 and −0.25, between −0.25 and −0.50, between −0.25 and −0.80, between −0.05 and −0.95 or between −0.05 and −0.85.

In some embodiments, the tessellated encapsulating bra cups in combination with the gore form a single molded piece. Moreover, in some embodiments each tessellated encapsulating bra cup forms an individual molded piece. These individually molded pieces are discrete from each other, meaning they are not coupled together or formed from a common piece in such embodiments.

In some embodiments, the tessellated encapsulating bra cups in combination with the gore and the molded cradle form a single molded piece.

In some embodiments, the molded cradle includes a thermoplastic elastomer or thermoplastic rubber or resin. For instance, in some embodiments, the thermoplastic elastomer is a styrenic block copolymer, a thermoplastic polyolefinelastomer, a thermoplastic vulcanizate, a thermoplastic polyurethane, a thermoplastic copolyester, or a thermoplastic polyamide.

In some embodiments, the cradle includes a second curvature with respect to a second plane, where the second plane is orthogonal to the first plane of the first curvature.

In some embodiments, a bottom portion of the band forms an underhand. In some embodiments, the underband has an inner surface that has a first textile strip is attached to a portion of the inner surface of the underband that is below the channel. The first textile strip is configured to adhere to a surface of a torso when the first textile strip, or the surface of the torso, is damp.

In some embodiments, the front portion of the band includes an outer textile layer and a single inner pad layer. Each tessellated encapsulating bra cup is fitted into the corresponding cup region between the outer textile layer and a respective portion of the single inner pad layer.

In some embodiments, the single inner pad layer includes a compressible auxetic polymeric foam having a negative Poisson's ratio.

In some embodiments, the front portion of the band includes the outer textile layer that overlays a single outer pad layer. The front portion of the band also includes the single inner pad layer. Accordingly, each tessellated encapsulating bra cup is fitted into the corresponding cup region between the single outer pad layer and the respective portion of the single inner pad layer.

In some embodiments, the single inner pad layer and the single outer pad layer each include a compressible auxetic polymeric foam having a negative Poisson's ratio.

In some embodiments, an upper portion of the single inner pad layer is affixed with a second textile strip. The second textile strip is configured to adhere to a surface of the torso when the second textile strip, or the surface of the torso, is damp.

In some embodiments, the front portion of the band includes a textile. The textile has an interior surface that contacts a torso and an exterior surface that opposes the interior surface of the front portion of the band. Each tessellated encapsulating bra cup is fitted onto the corresponding cup region on the exterior surface of the textile.

In some embodiments, the bra includes a first bra pad that is fitted into at least a portion of the first concave inner face, and a second bra pad that is fitted into at least a portion of the second concave inner face.

In some embodiments, the bra includes the first bra pad that is fitted over at least a portion of the first convex outer face. Similarly, the second bra pad is fitted over at least a portion of the second convex outer face.

In some embodiments, the underband includes an interruption which has a first side and a second side. A gusset is bonded to the first side and the second side of the interruption, which reunites the underband. The underband is formed of a first elastic blend which has a first percent extensibility when placed under a first strain. The gusset is formed of a second elastic blend that has a second percent extensibility when placed under the first strain. The second percent extensibility is greater than the first percent extensibility, allowing the gusset to have greater deformation potential than the underband.

In some embodiments, the second percent extensibility is ten percent greater than the first percent extensibility, fifteen percent greater than the first percent extensibility, twenty percent greater than the first percent extensibility, twenty-five percent greater than the first percent extensibility, thirty percent greater than the first percent extensibility, thirty-five percent greater than the first percent extensibility, forty percent greater than the first percent extensibility, forty-five percent greater than the first percent extensibility, fifty percent greater than the first percent extensibility, fifty-five percent greater than the first percent extensibility, sixty percent greater than the first percent extensibility, or sixty-five percent greater than the first percent extensibility.

In some embodiments, the gusset is formed in a portion of the underband that is below the back portion of the band.

In some embodiments, the gusset is formed in a portion of the underband that is below the first underarm or the second underarm portion of the band. In some embodiments, a first gusset is formed in a portion of the underband that is below the first underarm, and a second gusset is formed in a portion of the underband that is below the second underarm.

In some embodiments, a distance between a point on the first side and a point on the second side of the interruption of the gusset is between one centimeter (cm) and nine cm. In some embodiments, the distance between the point on the first side and the point on the second side of the interruption is between two cm and seven cm. In some embodiments, the distance between the point on the first side and the point on the second side of the interruption is between three cm and six cm. In some embodiments, the distance between the point on the first side and the point on the second side of the interruption is between four cm and five cm. In some embodiments, the distance between the point on the first side and the point on the second side of the interruption is between two cm and five cm.

In some embodiments, the underband has a first width that is perpendicular to a length of the first elastic blend of the underband. Accordingly, the gusset has a variable width along the length of the first elastic blend of the underband that tapers between the first width at the first side of the interruption and is less than the first width at the second side of the interruption.

In some embodiments, the gusset has a width that is greater than a centimeter at the first side of the interruption and a width that is less than a centimeter at the second side of the interruption. In some embodiments, the gusset has the width that is greater than 1.3 centimeters at the first side of the interruption and the width that is less than 0.3 centimeters at the second side of the interruption.

In some embodiments, the bra includes a first strap that is bonded to a first position on the underband. This first position is proximate to the first side of the interruption adjacent to the gusset. A strap loop is secured to a second position on the underband. This second position is proximate to the second side of the interruption. A touch fastener component has a first backing member that supports a first plurality of engagement elements, which extend from one surface of the first backing member. The first backing member is bonded, or sewn, to a terminal face of the first strap. A mating touch fastener component includes a second backing member that supports a second plurality of engagement elements. This second backing member is bonded, or sewn, to a third position of the underband. This third position of the underband is proximate to the first position of the underband away from the gusset. The strap is configured to loop through the strap loop so that the first plurality of engagement elements engages a subset of the second plurality of engagement elements. This engagement enables the touch fastener component to releasably fasten to the mating tough fastener component, which adjusts a tightness of the underband on a torso.

In some embodiments, a second strap similar to the first strap is bonded to a second position of the underband that is proximate to a first side of another interruption adjacent to another gusset.

In some embodiments, the second fastener (e.g., the mating fastener) is longer than the first fastener (e.g., the touch fastener).

In some embodiments, a first intermediate member interconnects and isolates the first backing member from the terminal face of the first strap. A second intermediate member interconnects and isolates the second backing member from the underband. The first intermediate member and the second intermediate member are configured to reduce noise by dampening vibrations traversing through the intermediate members when the touch fastener component is disengaged from the mating touch fastener component.

In some embodiments, the first intermediate member and the second intermediate member each includes a spandex material, an elastomeric material, a non-woven material, a braided material, a foam material, or a diamond mesh material.

In some embodiments, the first backing member and the second backing member each include an elastic material. The touch fastener is formed from a knitted material that includes a first plurality of loops. The first plurality of engagement elements is formed from a subset of the first plurality of loops by disrupting the subset of the first plurality of loops. This disrupting causes each loop in the subset of loops to form an engagement element, of the first plurality of engagement elements, in the form of a microhook. The mating touch fastener is formed from a knitted material that includes a second plurality of loops that serve as the second plurality of engagement elements, wherein individual loops in the second plurality of loops reversibly engage with individual engagement elements in the first plurality of engagement elements.

In some embodiments, the bra further includes a first shoulder strap adjoining one of the corresponding cup region and a first portion of the back portion of the band. A second shoulder strap adjoins the other of the corresponding cup region and the first portion of the back portion of the band. A touch fastener component having a first backing member, which supports a first plurality of engagement elements, extends from one surface of the first backing member. Moreover, the first backing member is bonded, or sewn, to a terminal face of the first shoulder strap. A mating touch fastener component includes a second backing member that supports a second plurality of engagement elements. This second backing member is bonded, or sewn, to a base position of the first shoulder strap on the same side as the touch fastener component. A strap loop is secured to a terminal position of the second shoulder strap, and is configured to receive and loop through the shoulder loop so that the first plurality of engagement elements engages a subset of the second plurality of engagement elements to releasably fasten the left touch fastener component to the left mating tough fastener component. This adjusts a tightness of the first left strap and the second left strap on a torso. In some embodiments, the corresponding touch fastener and mating fastener of each shoulder strap are adjustable.

In some embodiments, the mating fastener and the touch fastener of each strap are magnetized. For instance, in some such embodiments, the mating fastener and the touch fastener of each strap are each magnetized with a corresponding single neodymium magnet. In other embodiments, the mating fastener and the touch fastener of each strap are each magnetized with a corresponding plurality of neodymium magnets. In still other embodiments, the mating fastener and the touch fastener of each strap are each magnetized with a corresponding array of neodymium magnets that effect a first twist on and twist off releasable attachment of the corresponding first strap to the corresponding second strap.

In some embodiments, a third textile strip is affixed to an inner facing surface of the upper portion which is above each cup region. The third textile strip is configured to adhere to a surface of a torso when the third textile strip, or the surface of the torso, is damp. In some such embodiments, the third textile strip is between 0.5 centimeters and 2.0 centimeters wide.

Another aspect of the present disclosure provides a bra comprising a band configured to wrap around a torso, where the band comprises a back portion, a first underarm portion, a second underarm portion, and a front portion, where the front portion is connected to the back portion through both the first underarm portion and the second underarm portion. The band comprises a first cup region, a second cup region, a channel running below the first cup region and the second cup region, the channel formed between an inner fabric and an outer fabric, a gore above the channel and between the first cup region and the second cup region, the gore adjoining the first cup region and the second cup region, and a molded cradle fitted into the channel, wherein the molded cradle has at least a first curvature in a first plane. A first tessellated encapsulating bra cup is fitted into the first cup region. The first tessellated encapsulating bra cup comprises a first plurality of tiles. Respective tiles in the first plurality of tiles that are further away from the molded cradle are larger in size than respective tiles in the first plurality of tiles that are closer to the molded cradle. The first tessellated encapsulating bra cup has a generally concave first inner face and a generally convex first outer face. A second tessellated encapsulating bra cup fitted into the second cup region. The second tessellated encapsulating bra cup comprises a second plurality of tiles. Respective tiles in the second plurality of tiles that are further away from the molded cradle are larger in size than respective tiles in the second plurality of tiles that are closer to the molded cradle. The second tessellated encapsulating bra cup has a generally second concave inner face and a generally convex second outer face. The first tessellated encapsulating bra cup and the second tessellated encapsulating bra cup collectively contribute cantilevered support to the bra. In some such embodiments, each respective tile in at least a first subset of the first plurality of tiles and each respective tile in at least a second subset of the second plurality of tiles is hollowed. Alternatively, in some embodiments, each respective tile in at least a first subset of the first plurality of tiles and each respective tile in at least a second subset of the second plurality of tiles is hollowed.

In some embodiments, the first tessellated encapsulating bra cup comprises a first outer boundary and each respective tile in the first plurality of tiles that is contacting the first outer boundary is triangular in shape, and each respective tile in the first plurality of tiles that is not contacting the first outer boundary is approximately quadrilateral in shape. In such embodiments, the second tessellated encapsulating bra cup comprises a second outer boundary and each respective tile in the second plurality of tiles that is contacting the second outer boundary is triangular in shape, and each respective tile in the second plurality of tiles that is not contacting the second outer boundary is approximately quadrilateral in shape. In some embodiments, the front portion of the band comprises an outer textile layer and a single inner pad layer and the first tessellated encapsulating bra cup is fitted into the first cup region between the outer textile layer and a first portion of the single inner pad layer. In some embodiments, the second tessellated encapsulating bra cup is fitted into the second cup region between the outer textile layer and a second portion of the single inner pad layer.

BRIEF DESCRIPTION OF THE DRAWINGS

Like reference numerals refer to corresponding parts throughout the several views of the drawings.

DETAILED DESCRIPTION

Figure 1:
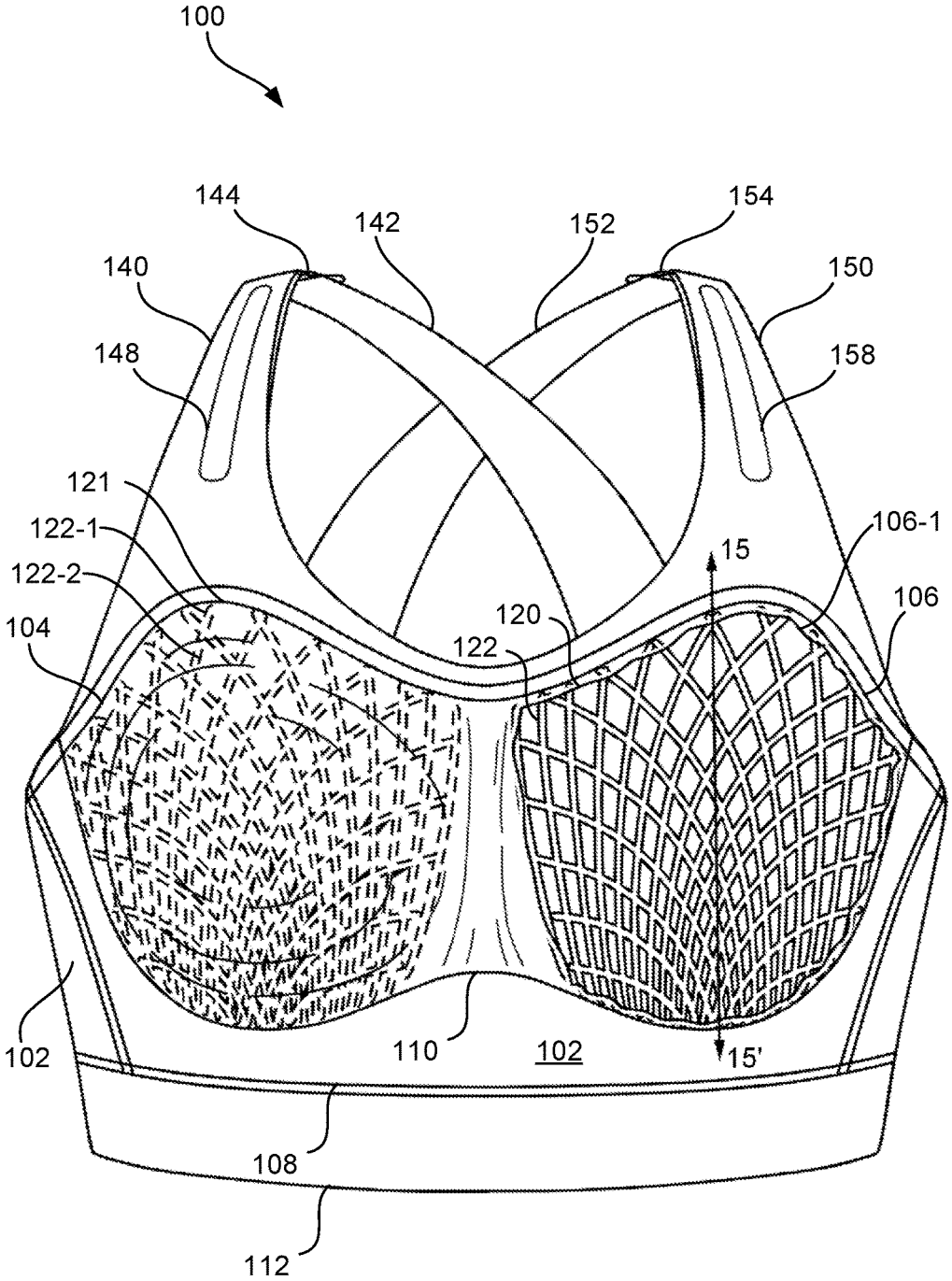
FIG. 1 illustrates a front view of a bra in accordance with an embodiment of the present disclosure.

Bras for use in high impact activities that require a high level of support are provided. A bra includes a band that wraps around a torso of a wearer. The band is defined by back portion, a first underarm portion, a second underarm portion, and a front portion. The back portion and the front portion are connected to each other through the first underarm portion and the second underarm portion. The band also includes a first cup region and a second cup region. A channel runs below both the first cup region and the second cup region, and is formed between and inner fabric and an outer fabric of the band. A gore is formed above the channel and between the first cup region and the second cup region, which adjoins the respective cup regions. Further, a molded cradle is fitted into the channel. For each respective cup region, a tessellated encapsulating bra cup is fitted therein. Each tessellated encapsulating bra cup includes a plurality of tiles. Respective tiles in the plurality of tiles that are further away from the cradle, or from a bottom portion of the band, are larger in size than respective tiles in the plurality of tiles that are closer to the cradle, or closer to the bottom portion of the. Each tessellated encapsulating bra cup has a generally concave first inner face and a generally convex first outer face. The tessellated encapsulating bra cups collectively contribute cantilevered support to the bra.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, and components have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first region could be termed a second region, and, similarly, a second region could be termed a first region, without departing from the scope of the present disclosure. The first region and the second region are both regions, but they are not the same region.

The terminology used in the present disclosure is for the purpose of describing particular embodiments only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "fabric" means a material used in the construction of the present disclosure. Fabrics include natural fibers (e.g., cotton, hemp, flax, fur, jute, linen, silk, wool, etc.) and/or synthetic fibers (e.g., latex, nylon, polyester, polyurethane, rayon, rubber, silicon, spandex, etc.), or a blend thereof. Additionally, these fabrics may have any suitable weave used in the art (e.g., twill weave, plain weave, satin weave, etc.), or have any suitable bonding or felting used in the art. Moreover, unless expressly stated otherwise, the term "fabric" includes general materials used in productions of garments such as elastics, metals, and plastics.

Further, as used herein, the term "tessellated" means a tiling of a plane using one or more geometric shapes, hereinafter "tiles," with no overlaps or gaps therebetween. For instance, in some implementations the tessellation of a region refers to the tiling of a plane, or surface, that defines the region (e.g., the tessellation of a plane in a 2D polar coordinate system, the tessellation of a surface in a 3D spherical coordinate system).

Additionally, as used herein, the term "right" means a right hand side with respect to a perspective of a wearer of a bra of the present disclosure. Similarly, as used herein, the term "left" means a left hand side with respect to the perspective of the wearer of the bra of the present disclosure.

In some implementations, the present disclosure provides a variety of bras for use by a wearer. However, the present disclosure is not limited thereto. For instance, in some implementations the present disclosure provides a variety of swimsuit tops (e.g., a bikini top). In other implementations, the present disclosure may be integrally combined with an article of clothing, for example, a blouse, a dress, a shirt, a wetsuit, etc.

Figure 2:
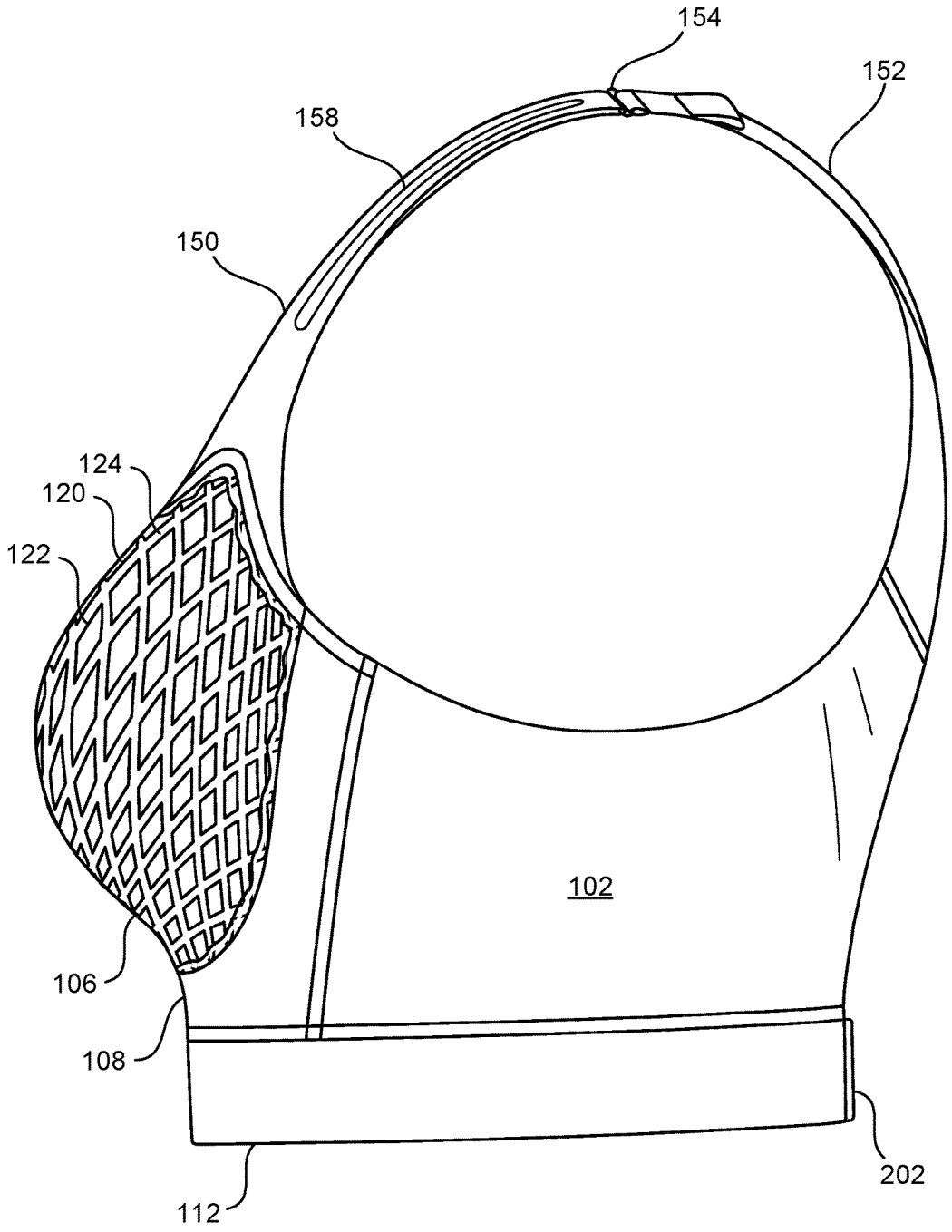
FIG. 2 illustrates a side view of the bra of FIG. 1.

Referring to FIGS. 1 and 2, a bra 100 is illustrated in accordance with various implementations of the present disclosure. The bra 100 includes a band 102 that wraps around a torso of a wearer. The band includes 102 a back portion which is proximate to a spine of the wearer, a front portion which is proximate to the breasts of the wearer, and underarm portions which correspond to each arm of the wearer. The front portion of the band 102 is connected to the back portion through the respective underarm portions. These connections from the front portion and the back portion to the respective under arm portions may be sewn, bonded, or integrally formed (e.g., as a continuous piece of fabric, as a molded piece). In preferred embodiments they are bonded.

In various implementations, the band 102 is formed from a single ply of fabric. Likewise, in other implementations, the band 102 is formed from a double ply, or two-ply, of fabric, from a three-ply of fabric, from a multi-ply of fabric or, in further implementations, from a combination of plies. For instance, in some implementations a first portion of the band 102 is formed from a first ply of fabric (e.g., the front portion of the band and the back portion of the band are formed from a two-ply fabric), while a second portion of the band 102 is formed from a second ply (e.g., the underarm portions of the band are formed from a single-ply fabric).

Similarly, in various implementations the band 102 is formed from a single type of fabric. Likewise, in other implementations the band 102 is formed from a variety of fabrics. For instance, in some implementations the first underarm portion of the band 102, the second underarm portion of the band, and the back portion of the band are formed from a first fabric (e.g., formed from a fabric that includes a cotton and a polyester blend), while the front portion of the band is formed from a second fabric (e.g., formed from a wool felt fabric). Additionally, in some implementations the band 102 is formed from a single layer of fabric. In other implementations, the band 102 is formed from at least two layers of fabric (e.g., an inner fabric 1502 and an outer fabric 1510 of FIG. 15). The fabric of the band 102 may be bonded in various portions (e.g., the inner fabric 1502 is bonded to the outer fabric 1510). These implementations are merely exemplary, and other materials and configurations of the band 102 are also contemplated that will be discussed in more detail infra. In some implementations, the front portion of the band includes an outer textile layer (e.g., outer textile layer 1510 of FIG. 15) and a single inner pad layer (e.g., inner pad layer 306 of FIG. 3). These implementations of the front portion and more will be described in more detail infra.

In various implementations, the band 102 includes corresponding cup regions (e.g., cup regions 104 and 106). These cup regions (104, 106) are utilized to support, surround, lift, and/or cover the breasts of the wearer. In some implementations, the cup regions (104, 106) also provide an ornamental effect on the bra 100, which includes at least a shape of the cup regions and a texture of the fabric of the cup regions. In various implementations, and with reference to FIGS. 1 and 2, the cup regions (104, 106) are formed with a similar size and a similar shape. However, the present disclosure is not limited thereto. For instance, in some implementations, such as when the breasts of the wearer are asymmetric, one region (e.g., the first cup region 104) is formed with a different size cup than the other cup region (e.g., the first cup region is smaller than the second cup region, or the first cup region is larger than the second cup region). Similarly, in some implementations one cup region (e.g., the first cup region 104) is formed in a different shape than the other cup region cup region 106. For instance, in some implementations each cup region is shaped in an identical manner (e.g., each cup region is perfectly symmetric), whereas in other implementations each cup region is shaped in a manner that is symmetric about a vertical plane (e.g., the cup shapes are mirror images of each other). Cup shapes include, but are not limited to, balconette cups, balcony cups, contour cups, demi cups, full cups, lined cups, minimizer cups, nursing cups, padded cups, petite cups, plunge cups, push-up cups, seamed cups, and soft cups. The exact cup shape is determined by accounting for at least a required level of support of the breasts as well as the ornamental affect imparted by the cup shape.

Figure 3:
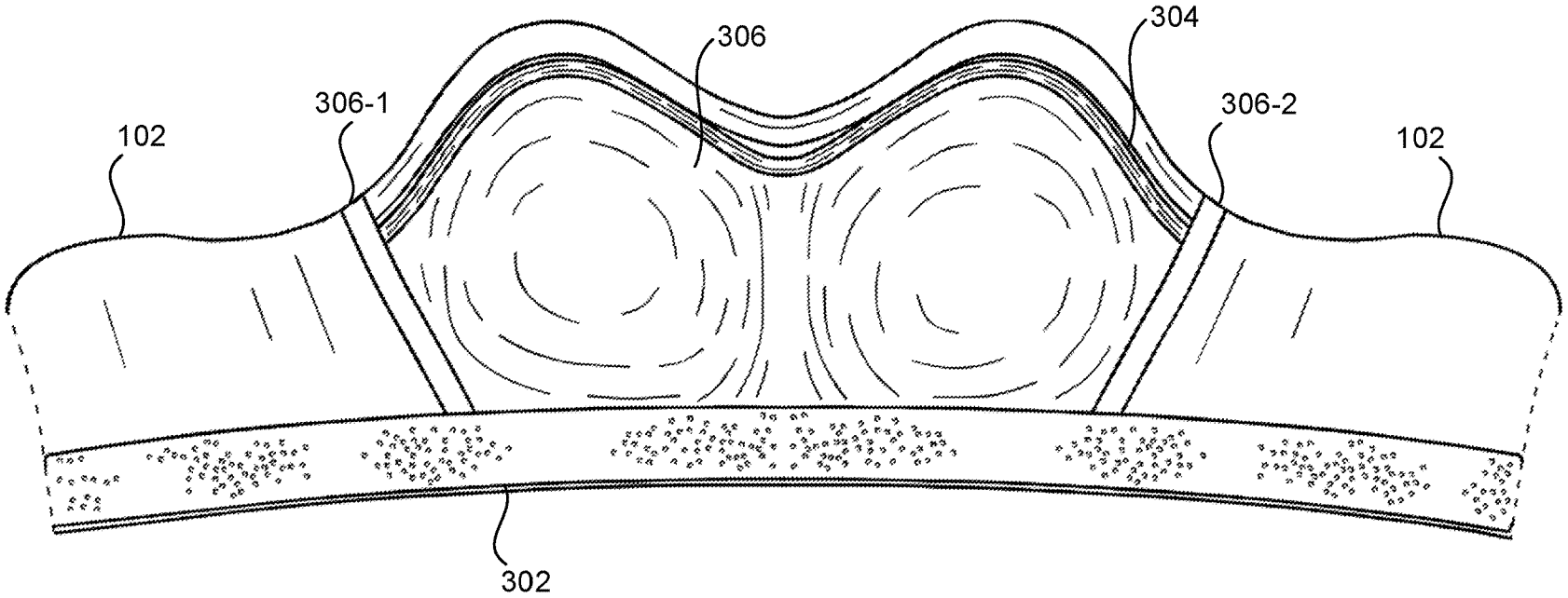
FIG. 3 illustrates a back view of another bra in accordance with an embodiment of the present disclosure.
Figure 4:
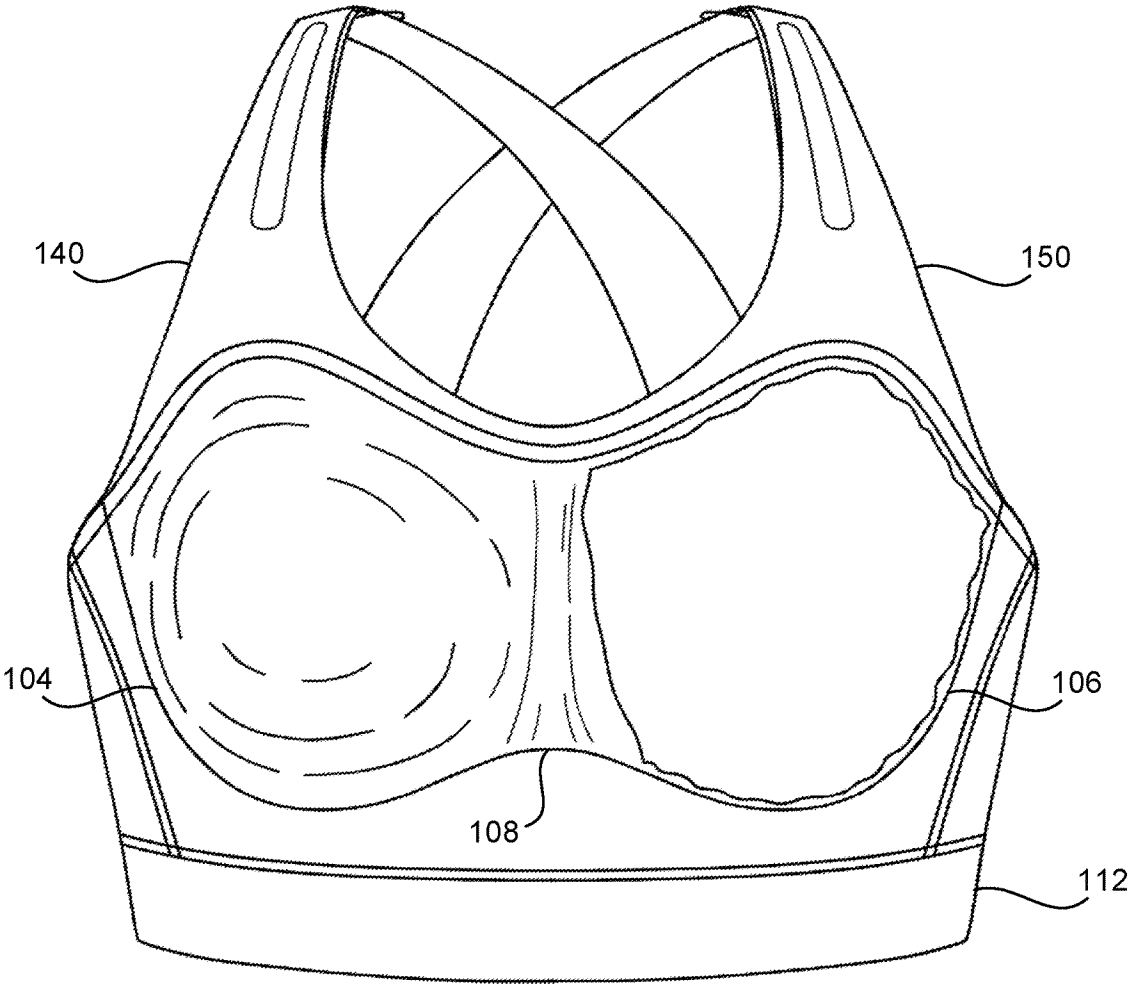
FIG. 4 illustrates a front view of yet another bra in accordance with an embodiment of the present disclosure.
Figure 5:
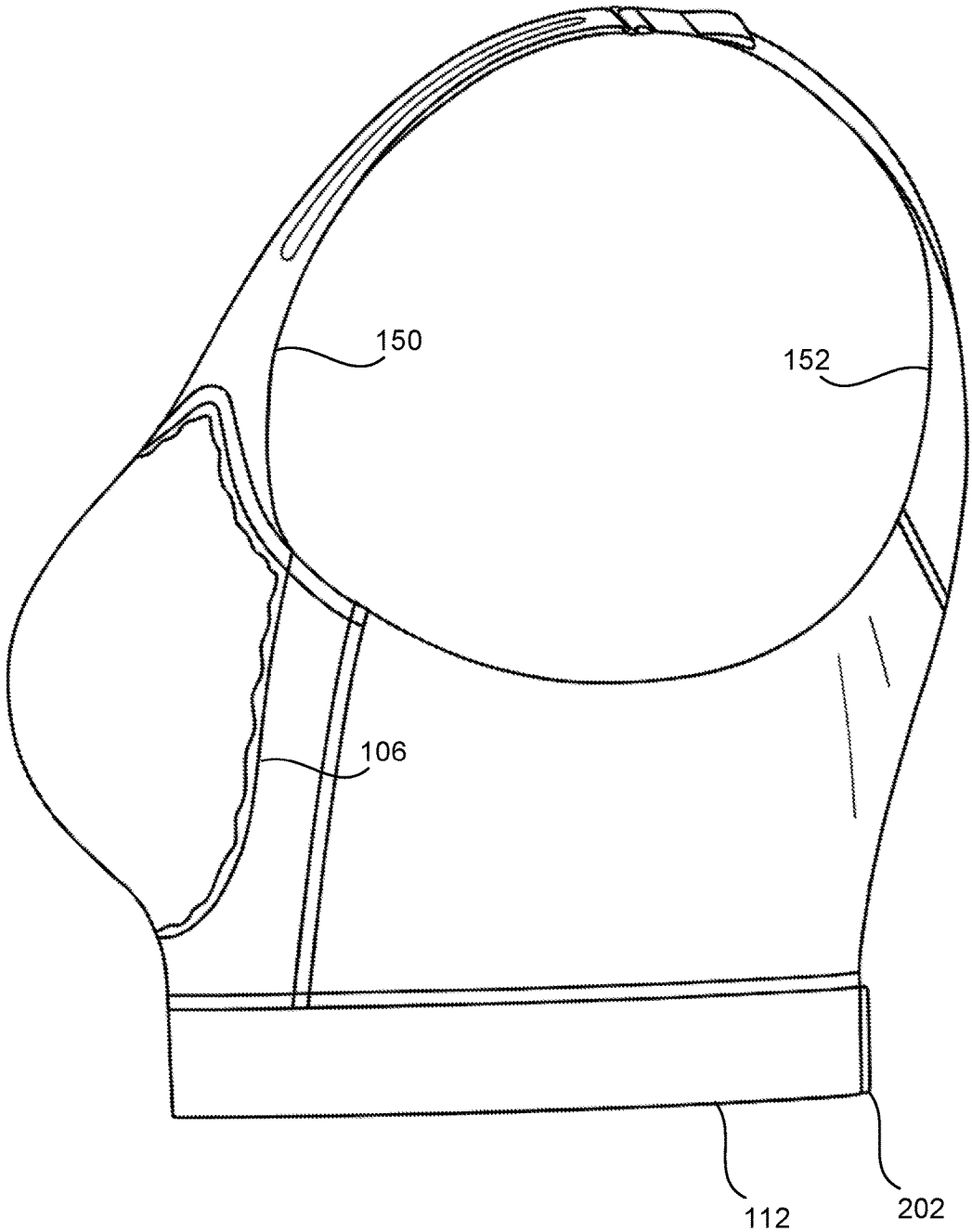
FIG. 5 illustrates a side view of the bra of FIG. 4.

In various implementations, and as illustrated in at least FIG. 3, the band 102 is formed as a continuous piece of fabric (e.g., a loop of fabric) and fully encapsulates the various components (e.g., front, back and underarms) of the bra 100. As described supra, in some implementations the continuous piece of fabric is formed from a single piece of fabric (e.g., seams 306-1 and 306-2 of FIG. 3 are omitted), while in other implementations the continuous piece of fabric is formed from a variety of fabrics that are sewn and/or bonded together. This continuity of the band 102 allows for the wearer to pull the bra on (e.g., the bra is of a pull-on type) by placing their head and arms through the band 102 and pulling the bra 100 downwards towards the torso.

Figure 8:
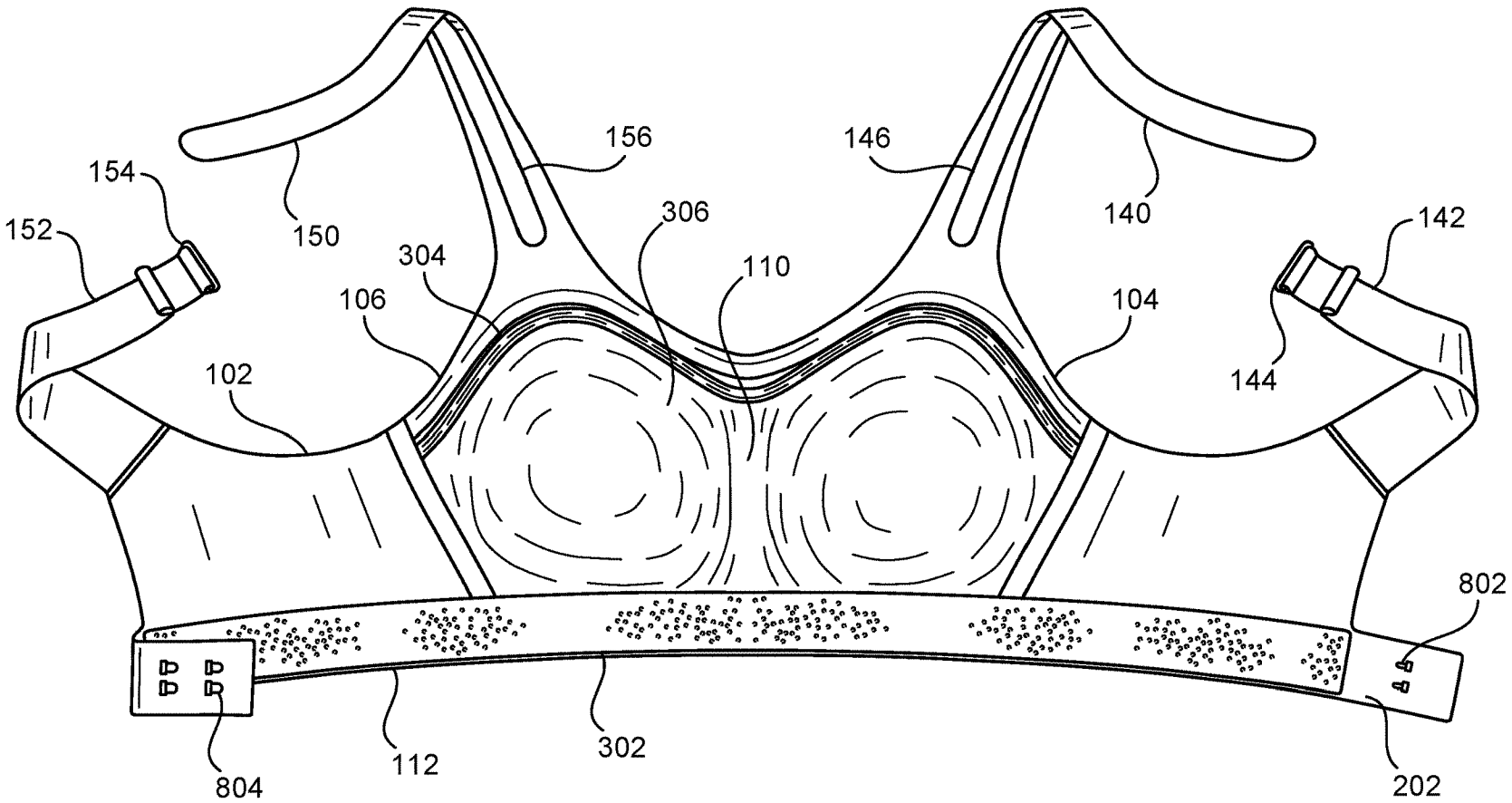
FIG. 8 illustrates a back view of the bra of FIG. 1.

Further, in other implementations, as illustrated in at least FIGS. 2 and 8, the band 102 is interrupted by a clasp 202 to form a discontinuous piece of fabric. In some implementations, the clasp 202, and therefore the interruption, is disposed on a portion of the back portion of the band. However, the present disclosure is not limited thereto. In other implementations, the clasp 202 is disposed on either underarm portion of the band 102, on the front portion of the band, or on a combination thereof. The clasp 202 is characterized by either an unhitched state (e.g., an open state as shown in at least FIG. 8) or a hitched state (e.g., a closed state as shown in at least FIGS. 2 and 18). In various implementations, the clasp 202 includes a first fixture 802 and a second fixture 804 which are removably coupled together and are responsible for configuring the band 102 between the unhitched state and the hitched state. In the unhitched state, the band 102 is opened (e.g., the first fixture 802 and the second fixture 804 of the clasp 202 are uncoupled from each other as shown in at least FIGS. 8 and 17) to allow for removal or placement of the bra 100 on the torso of the wearer. Similarly, in the hitched state, the band 102 is closed (e.g., the first fixture 802 and the second fixture 804 of the clasp 202 are coupled together as shown in at least FIGS. 2 and 18) to allow for the bra to affix to the torso of the wearer. In some implementations, the first fixture 802 is one or more hooks, while the second fixture is one or more eyes that are configured to receive the hooks of the first fixture 802. In some implementations, the first fixture 802 is a hook type fastener, while the second fixture is a loop type fastener that is configured to receive the hooks of the first fixture 802. In some implementations, the first fixture 802 is a first magnet with a first polarity, while the second fixture is one or more second magnets with a second polarity, which is configured to attract the first polarity of the first fixture 802. Moreover, in some implementations the fixtures (802, 804) are formed via injection molding with a rubberized material. Further, in some implementations the fixtures (802, 804) are bonded or sewn to the bra 100. Additional details regarding various types of fixtures (802, 804) of the clasp 202 and their respective coupling mechanisms will be described in more detail infra.

Referring back to FIGS. 1 and 2, a channel 108 is formed on the bra 100 that runs below the first cup region 104 and the second cup region 104. In various embodiments, the channel 108 is formed between an inner fabric (e.g., inner fabric 1502 of FIG. 15) and an outer fabric (e.g., outer fabric 1510 of FIG. 15) of the bra 100. In some implementations, the channel is formed between an inner fabric (e.g., inner fabric 1502 of FIG. 15) and an outer fabric (e.g., outer fabric 1502 of FIG. 15) of the band 102.

A gore 110 is formed above the channel 108 and between the first cup region 104 and the second cup region 106. The gore 110 is configured to adjoin the first cup region 104 and the second cup region 106 together, forming a bridge there between. In some implementations, the gore 110 is formed from an elastic fabric such as an elastic yarn knit, whereas in other implementations the gore is formed from a relatively inelastic fabric, such as cotton. During use, the gore 110 lies flat against and abuts a chest of the wearer, in between the breasts.

In various implementations, a molded cradle 130 (e.g., the molded cradle 130 of FIG. 6) is fitted into the channel 108 that assists in positioning the gore 110 as well as the first cup region 104 and the second cup region 106 to the chest of the wearer. In some implementations, the cradle 130 is fitted into the channel 108 by disposing the cradle between the inner fabric (e.g., inner fabric 1502 of FIG. 15) and the outer fabric (e.g., outer fabric 1510 of FIG. 15) of the band 102. Likewise, in other implementations the cradle 130 is fitted into the channel 108 by bonding the molded cradle to the channel. In some implementations, the cradle 130 is a wire. To allow the bra 100 to rest comfortably against the wearer, the cradle 130 is formed with at least a first curvature in a first plane. In some implementations, the cradle 130 is also formed with a second curvature in a second plane, which is orthogonal to the first plane of the first curvature. These curvatures are designed to match various contours of the wearer of the bra, such as a contour of the torso and a contour of each breast region.

In order for the cradle 130 to rest comfortably against the wearer, the cradle is formed of a flexible material. Moreover, in some implementations the cradle 130 is formed via an additive manufacturing process in some embodiments. For instance, in some implementations, the cradle 130 is formed via injection molding. In other implementations, the cradle 130 is formed via a three-dimensional printing process such as fused deposition modeling (FDM), stereolithographic (SLA), or selective laser sintering (SLS). Materials used to form the cradle 130 in various embodiments of the present disclosure include thermoplastic elastomers (TPE) such as thermoplastic rubbers and resins, a variety of foams such as auxetic foam or polyurethane foam, a variety of plastics (e.g., polylactic acid (PLA) and polyvinyl alcohol plastic (PVA)), as well as silicon. For instance, thermoplastic elastomers and resins include a styrenic block copolymer, a thermoplastic polyolefinelastomer, a thermoplastic vulcanizate, a thermoplastic polyurethane, a thermoplastic copolyester, or a thermoplastic polyamide. These materials and other materials that form various components and portions of the bra 100 will be described in more detail infra.

In the Figures, reference number 106-1 delineates a cutout of the corresponding cup region (104, 106) in order to depict internal details of the bra 100. As such, it will be appreciated that that cutout 106-1 is not actually found in bras of the present disclosure.

In various implementations, each cup region (104, 106) and the gore 110 combine to create a neckline on the front portion of the band 102. As described supra, each cup region (104, 106) is formed in any of a variety of shapes (e.g., a padded shape, a petite shape, a push-up shape), and, in collective combination with the gore 110, is responsible for forming a shape of the neckline. In some implementations, the shape of the neckline is formed by the band 102. The shape of the neckline includes shapes such as a full neckline, a part-full neckline, a balconette neckline, a half-cup neckline, a plunge neckline, etc. As will be described in more detail infra, the shape of the neckline in various implementations of the bra 100 is largely ornamental since a significant portion of support for the breasts is borne by other portions (e.g., the cups) of the bra.

As shown in FIGS. 1 and 2, in various implementations each cup region (104, 106) includes a tessellated encapsulating bra cup 120, hereinafter "tessellated cup." The tellesalation of each cup includes dividing an area into, or forming, a variety of tiles 122. For instance, in some implementations the tiles 122 of each tessellated cup 120 are incised or engraved into a fabric or material of the tessellated cup 120. In other implementations, a boundary 124 of the tiles 122 is incised or engraved into the fabric or material of the tessellated cup 120. In further implementations, the tiles 122 are formed from the fabric or material of the tessellated cup 120, whereas in other implementations the boundary 124 of the tiles 122 is formed from the fabric or material of the tessellated cup 120.

In various implementations, these tiles 122 of the tessellated cups 120 have a variety of shapes (e.g., triangular, quadrilateral, pentagonal, hexagonal, etc.) that is dependent on the shape of the cup, a location of the corresponding tile, a desired ornate effect, or a combination thereof. For instance, in some implementations, each tessellated cup 120 includes a first outer boundary (e.g., outer boundary 121 of FIG. 1) that defines a limit, or boundary, for forming the tiles 122. Each respective tile 122 of the tessellation 120 that is in contact with the first outer boundary (e.g., tile 121-1 of FIG. 1) is triangular in shape. Similarly, each respective tile 122 that is not in contact with the first outer boundary (e.g., tile 121-2 of FIG. 1) is approximately quadrilateral in shape. However, the present disclosure is not limited thereto. For instance, in some implementations each respective tile 122 of the tessellation 120 that is in contact with the first outer boundary 121 is either one of triangular, quadrilateral, or pentagonal, while each respective tile in the first plurality of tiles that is not in contact with the first outer boundary is approximately quadrilateral in shape. In some implementations, the tiles 122 are approximately oval in shape. Furthermore, in some implementations the tiles 122 are formed in a shape found in nature, such as an approximation of a web of a spider or an approximation of the veins in a lily pad. These structures (e.g., a spider web, a lily pad) provide natural, lightweight structures that yield a high level of support.

In various implementations, the tiles 122 are formed in a variety of sizes. The size of each tile 122 is dependent on the shape of the cup, a location of the respective tile, a desired ornate effect, or a combination thereof. For instance, in some implementations respective tiles 122 that are further away from the cradle 130, or a bottom portion of the band 102, are larger in size than respective tiles that are closer to the cradle, or the bottom portion of the band. Similarly, in other implementations each tile 122 has an identical size (e.g., a grid of squares, an array of circles). This change in size of the tiles 122 relative to a corresponding distance from a bottom portion of the bra 100 provides not only a portion of the support for the breasts through deformation of the tiles, but also has a visually pleasing, ornamental effect.

Moreover, in some implementations, each edge portion of each tile 122 is an approximate straight line. In other implementations, each edge portion of each tile 122 has a slight curvature. In some implementations, each edge portion of each tile 122 is either an approximate straight line or has a slight curvature.

In various implementations, and as illustrated in at least FIGS. 1 through 5, each tile 122 of each tessellated cup 120 is hollowed. This hollowed configuration of tiles 122 yields a solid boundary (e.g., boundary 124 of FIG. 2) between each tile. The hollowed tiles 122 enable a greater degree of deformation for the respective tessellated cup 120 depending on a material and a size (e.g., thickness and depth) of the boundary 124. However, the present disclosure is not limited thereto. For instance, referring to FIGS. 6 and 7, in some implementations each tile 122 of each tessellated cup 120 is formed as a solid structure. This solid structure yields a void for the boundary 124. In some implementations, each tile 122 is formed as a solid structure having a first height, and the boundary 124 is formed as another solid structure having a second height (e.g., either the tiles 122 or the boundary 124 is raised with respect to the other element). The solid tiles 122 enables a more restrictive degree of deformation for the respective tessellated cup 120.

In some implementations, each tessellated cup 120 is formed as an embroidery on an exterior portion of each respective cup region (104, 106). In some implementations, the embroidery of each tessellated cup 120 includes embroidering the entire respective tessellated cup 120. However, the present disclosure is not limited thereto. For instance, in some implementations a portion of each tessellated cup 120 is formed as an embroidery (e.g., a bottom end portion of each tessellated cup is formed as an embroidery). Furthermore, in some implementations each tessellated cup 120 is formed as described above with respect to the hollowed and/or solid tiles 122, and an embroidering of the underlying tessellated cup is formed on an exterior portion of each cup region (104, 106). The embroidering of the underlying tessellated cup 120 includes embroidering each tessellated cup 120 in its entirety as well as embroidering only a portion of each tessellated cup. For instance, in some implementations each cup region (104, 106) includes a respective tessellated cup 120 and only a portion of the respective tessellated cup 120 is embroidered on an exterior portion of the respective cup region. Furthermore, in some implementations one or more layers of material interpose between the embroidering of the tessellated cup 120 and each respective cup region (104, 106). The one or more layers of material that interpose the tessellated cup 120 and each respective cup region (104, 106) includes materials such as cotton, lace, mesh, nylon, polyester, silk, spandex, and the like. In some implementations, each respective cup region (104, 106) includes one or more respective layers of material that interpose the tessellated cup 120 and each respective cup region (e.g., a discrete first layer of material for a first cup region 104 and a discrete second layer of material for a second cup region 106). In some implementations, the embroidery of each tessellated cup 120 is flush with each respective cup region (104, 106) (e.g., a difference in height between the embroidery and a respective cup region is less than or equal to 0.1 millimeters (mm)). In some implementations, the difference in height between the embroidery and a respective cup region is less than or equal to 0.25 mm. In some implementations, the difference in height between the embroidery and a respective cup region is less than or equal to 0.5 mm. In some implementations, the difference in height between the embroidery and a respective cup region is less than or equal to 0.75 mm. In some implementations, the difference in height between the embroidery and a respective cup region is less than or equal to 0.1 mm. In some implementations, the difference in height between the embroidery and a respective cup region is less than or equal to 0.5 mm. In some implementations, the difference in height between the embroidery and a respective cup region is less than or equal to 0.75 mm. In some implementations, the difference in height between the embroidery and a respective cup region is less than or equal to 1 mm. In some implementations, the difference in height between the embroidery and a respective cup region is less than or equal to 2 mm. In some implementations, the difference in height between the embroidery and a respective cup region is less than or equal to 3 mm.

As previously described, various aspects of the present disclosure are directed to providing bras that incorporate cantilever support of the breasts via the tessellated cups 120, instead of supporting the breast via conventional suspension straps over the wearer's shoulders. The tessellated cups 120 allows each breast to independently move as a discrete mass, whereas conventional bras and cups often treat the breasts as a combined singular mass. This separation of the breasts provides exceptional comfort to the wearer while minimizing excessive movement of the breasts during strenuous or high impact activities such as sports. Since each breast is treated as an independent discrete mass that is encapsulated by the corresponding tessellated cup 120 and the respective cup region (104, 106), acceleration of the breast is reduced through deformation of the tessellated cup 120. This encapsulation reduces a degree of movement from an equilibrium position that each breast endures, as well as reducing pain caused incurred by the wearer by such movement. Further, since the tessellated cups 120 do not incorporate any protrusions towards the torso of the wearer, the cantilever support of the breasts is comfortable to the wearer. Additional details and information regarding the mechanics of the tessellated cups 120 and the cantilever support provided therefrom will be described in more detail infra.

In various implementations, the tessellated cups 120 and the gore 110 are formed as a single molded piece. Moreover, in some implementations each tessellated cup 120 is formed as an individual, discrete molded piece. These individually molded pieces are not connected to each other, and were not molded from a common piece. In some implementations, the tessellated cups 120, the gore 110, and the cradle 130 are formed as a single molded piece. In some implementations, the tessellated ups 120 are formed as a single molded piece. These molds and the materials thereof will be described in more detail infra.

In various implementations, and as illustrated in at least FIGS. 1, 3, and 15, the front portion of the band 102 includes an outer textile layer of fabric (e.g., outer fabric 1510 of FIG. 15) that overlays a single outer pad layer (e.g., fabric 1508 of FIG. 15). The front portion of the band 102 also includes a single inner pad layer 306, which rests against the breasts of the wearer. Each tessellated cup 120 is fitted into the corresponding cup region (104, 106) between the single outer pad layer 1508 and a first portion of the single inner pad layer 306.

In various implementations, and as illustrated in at least FIGS. 1, 2, and 15, each respective tessellated cup 120 is fitted into the corresponding cup region (104, 106). For instance, in some implementations each tessellated cup 120 is fitted into the corresponding cup region, and rests between the outer textile fabric 1510 and an inner fabric 1502. Each tessellated cup 120 is formed with a generally concave first inner face and a generally convex first outer face, which match a curvature of a breast. In some implementations, each tessellated cup 120 is fitted into the corresponding cup region (104, 106) between the outer textile layer 1510 and a first portion of the single inner pad layer 306, as illustrated in FIG. 15.

Figure 15C:
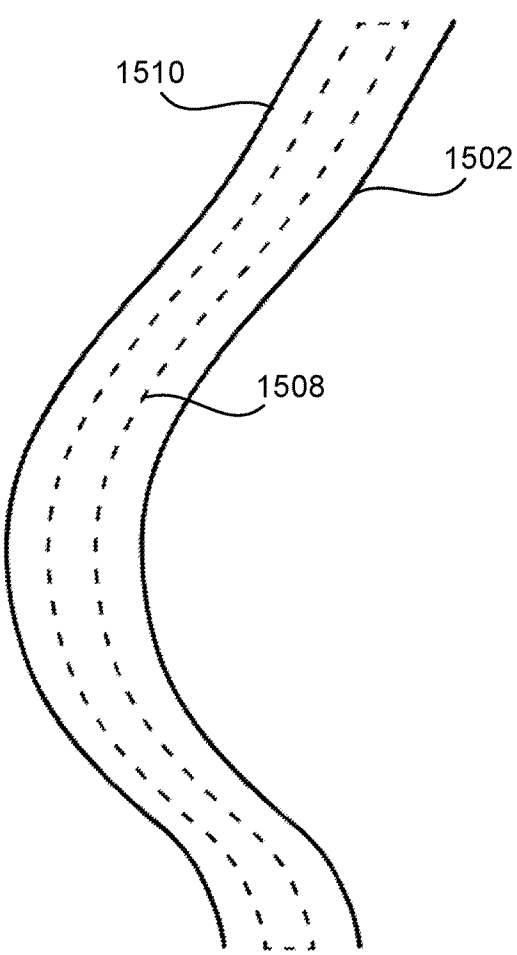
FIGS. 15A, 15B, 15C, 15D, 15E, and 15F collectively illustrate sectional views of line 15-15' of FIG. 1 in accordance with embodiments of the present disclosure.
Figure 15B:
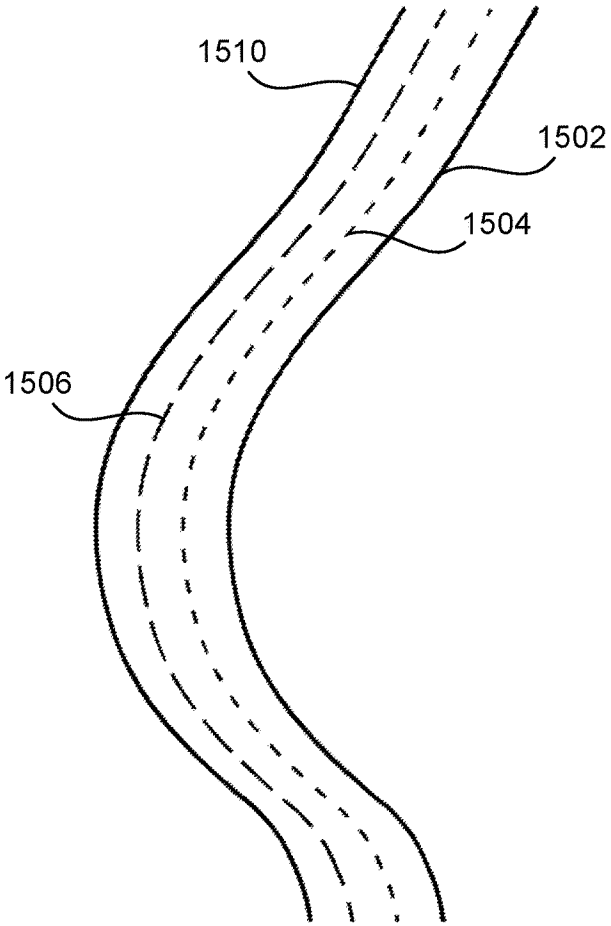
Figure 15A:
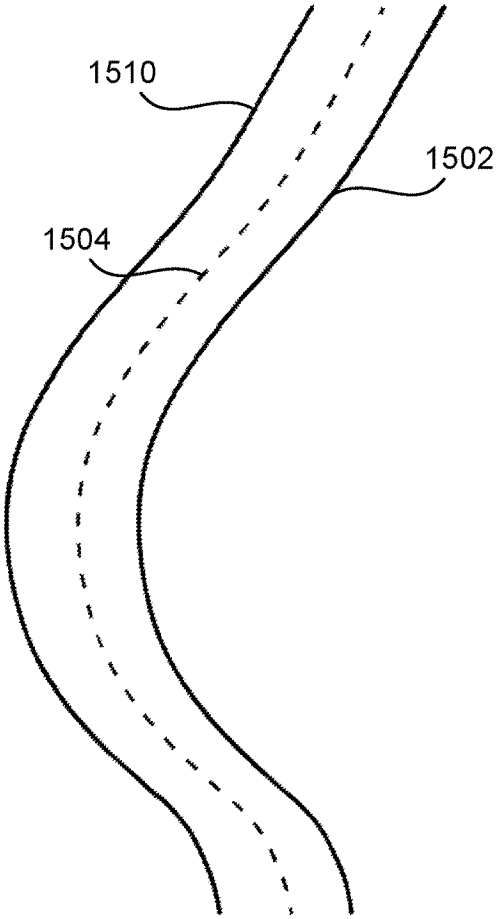
Figure 15F:
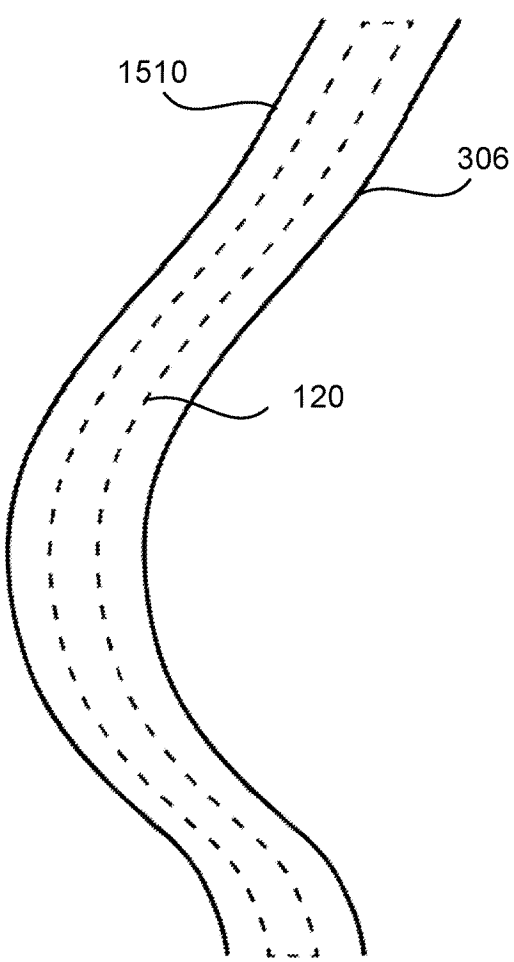
Figure 15E:
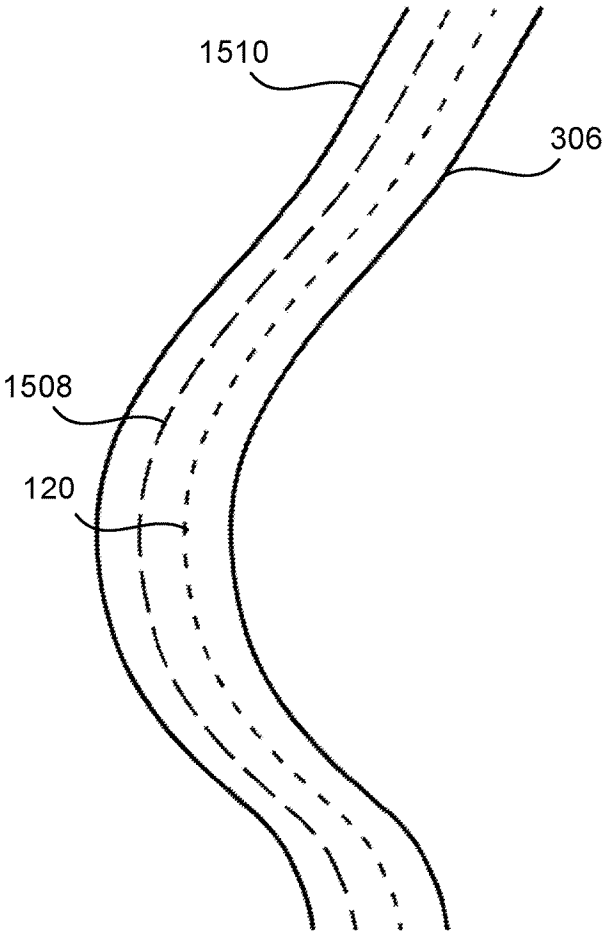
Figure 15D:
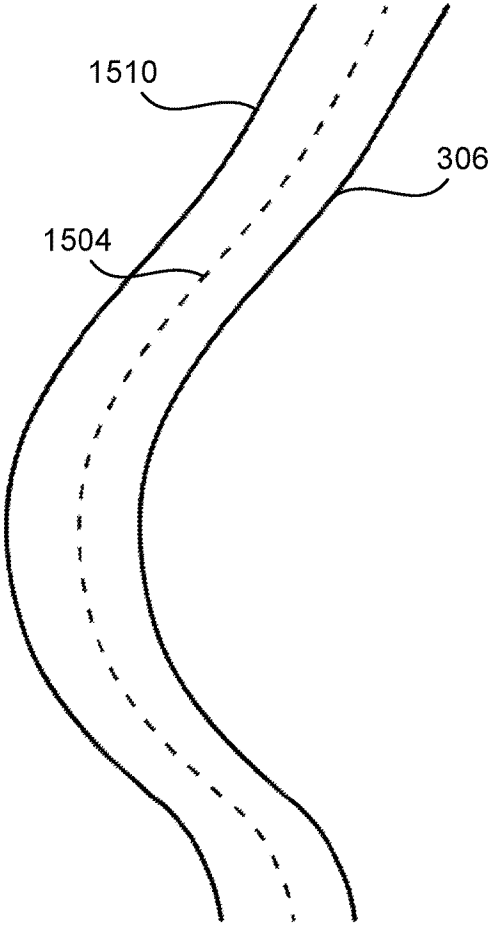

FIG. 15A illustrates an implementation in which a single layer of fabric 1504 is fitted between the outer textile layer 1510 and the inner fabric 1502. FIG. 15B illustrates an implementation in which the layer of fabric 1504 is accompanied with another layer of fabric 1506 to provide additional padding and support to the breasts. The fabric layer 1506 may be of a same fabric as the fabric layer 1504, but the present disclosure is not limited thereto. Moreover, FIG. 15C illustrates an implementation in which a pad 1508 is fitted between the outer textile layer 1510 and the inner fabric 1502 of the corresponding cup region (104, 106). In some embodiments, the pad 1508 is a foam pad or is formed from a material with a negative Poisson ratio (e.g., an auxetic material), which will be described in more detail infra. FIGS. 15D through 15F illustrates various implementations of the present disclosure in which the single inner pad layer 306 replaces the inner fabric 1502. However, the present disclosure is not limited thereto. Depending on an implementation of the present disclosure, a number of layers of fabric, a number of pads, a disposition of each tessellated cup 120, and an order thereof may be varied to create a variety of different implementations with various damping and support characteristics.

The implementations depicted in FIG. 15 are in no way limiting and instead are provided to give insight into various implementations of the present disclosure. For instance, while FIG. 15C illustrates a single pad 1508, in other implementations there may exists two pads 1508 in between the inner fabric 1502 and the outer fabric 1510, or any number of pads 1508 there between. Likewise, whereas in one implementation an outer fabric 1510 may be described as an outer textile layer, in another implementation an outer fabric 1510 may be described as an outer padded layer without departing for the scope of the present disclosure. One skilled in the art of the present disclosure will recognize that the implementations of FIG. 15 may be combined, either as a whole or in parts, to create other implementations of the present disclosure.

The fitting of the various layers of fabric, the pads, and tessellated cups 120 between the outer textile layer 1510 and the inner fabric 1502, or the single inner pad layer 306, is conducted in a variety of fashions. For instance, fitting each tessellated cup 120 into the corresponding cup region (104, 106) is accomplished either by sewing the tessellated cup to the cup region via seams 306 or by bonding the tessellated cup to a fabric of the corresponding cup region. Moreover, in some implementations the various layers of fabric, pads, and tessellated bra cups 120 are sewn between, or bonded to, the outer textile layer 1510 and the inner fabric 1502. In some implementations, the various layers of fabric, pads, and tessellated bra cups 120 are formed integrally with either the outer textile layer 1510 and/or the inner fabric 1502, or the single inner pad layer 306. In some implementations, each tessellated cup 120 is sewn onto an exterior portion of the corresponding cup region (104, 106). In other implementations, each tessellated cup 120 is sewn into an interior portion of the corresponding cup region (104, 106). In some implementations, each tessellated cup 120 is bonded to a portion (e.g., bonded to an interior surface of an inner fabric, bonded to an interior surface of an outer fabric) of the corresponding cup region (104, 106).

In various implementations, the front portion of the band 102 includes a textile fabric. The textile has an interior surface (e.g., inner fabric 1502) that contacts a torso of the wearer, and an exterior surface that opposes the interior surface of the front portion (e.g., outer fabric 1510) of the band 102. Accordingly, each tessellated cup 120 is fitted onto the corresponding cup region (104, 106) on the exterior surface of the textile (e.g., each tessellated cup 120 is disposed on the exterior of the outer fabric 1510). This exposed tessellation configuration allows for the tessellated cups 120 to impart an ornate effect on the bra 100 since the tessellated cups are visible externally to a person other than the wearer.

Figure 6:
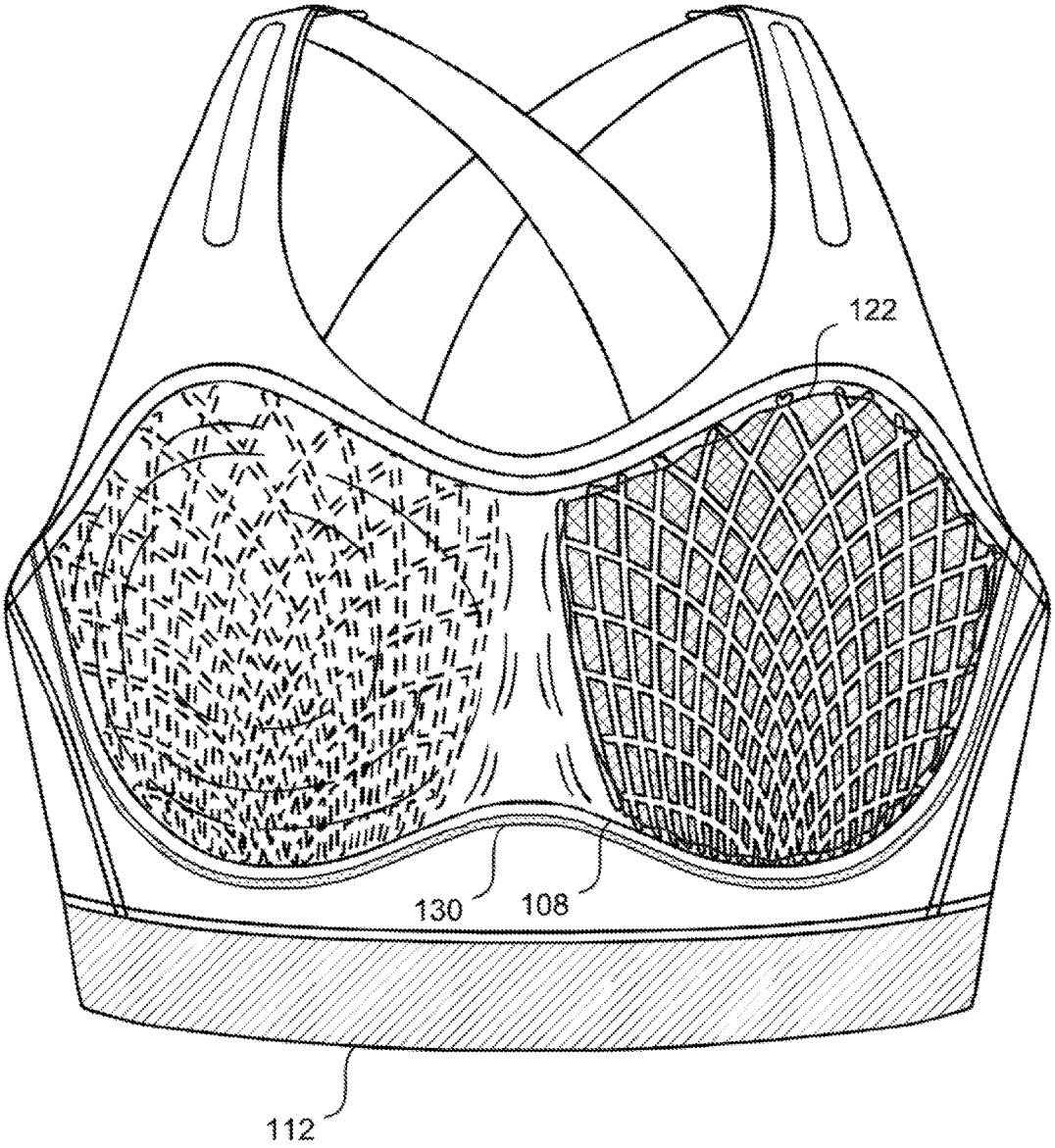
FIG. 6 illustrates a front view of yet another bra in accordance with an embodiment of the present disclosure.
Figure 7:
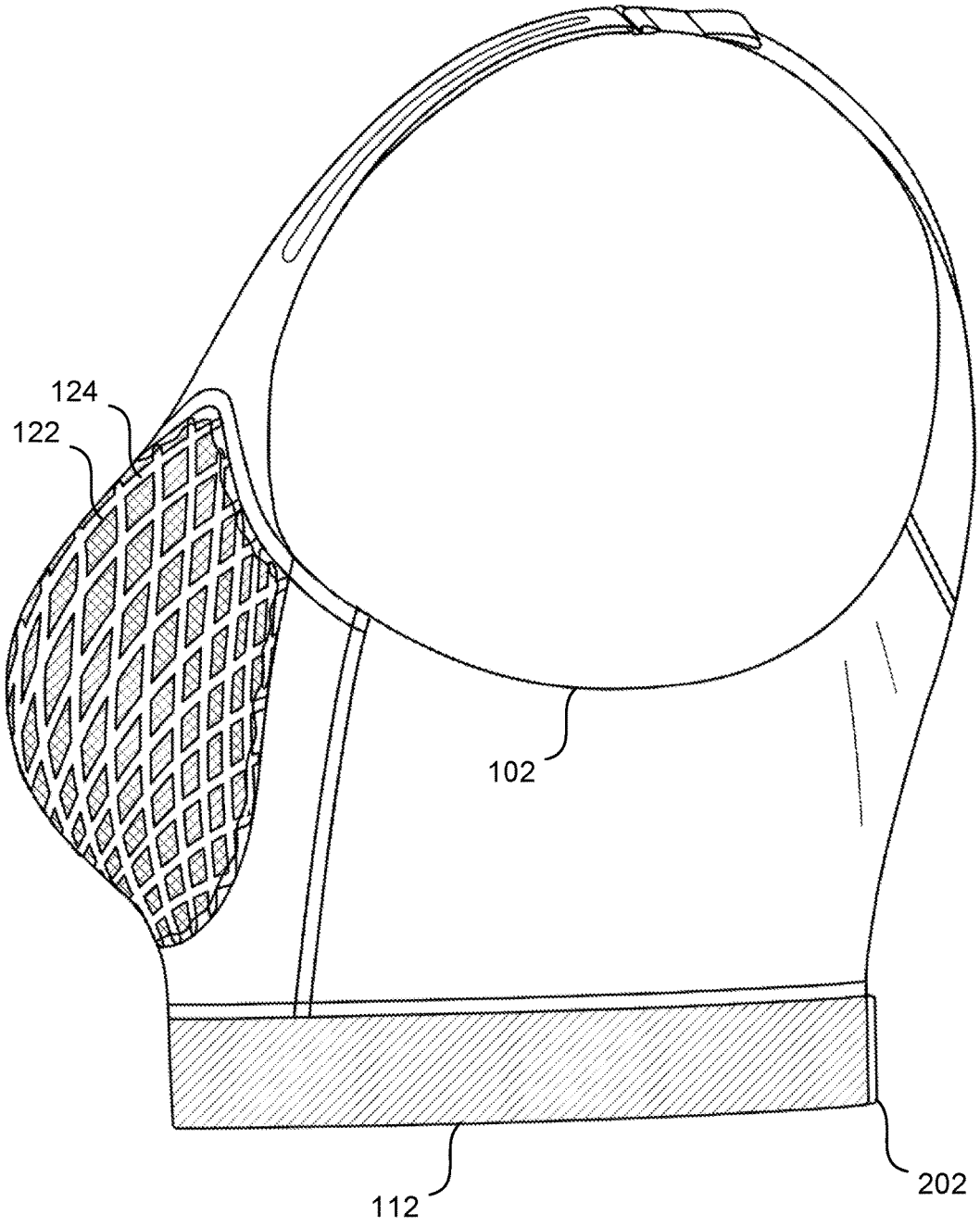
FIG. 7 illustrates a side view of the bra of FIG. 7.
Figure 17:
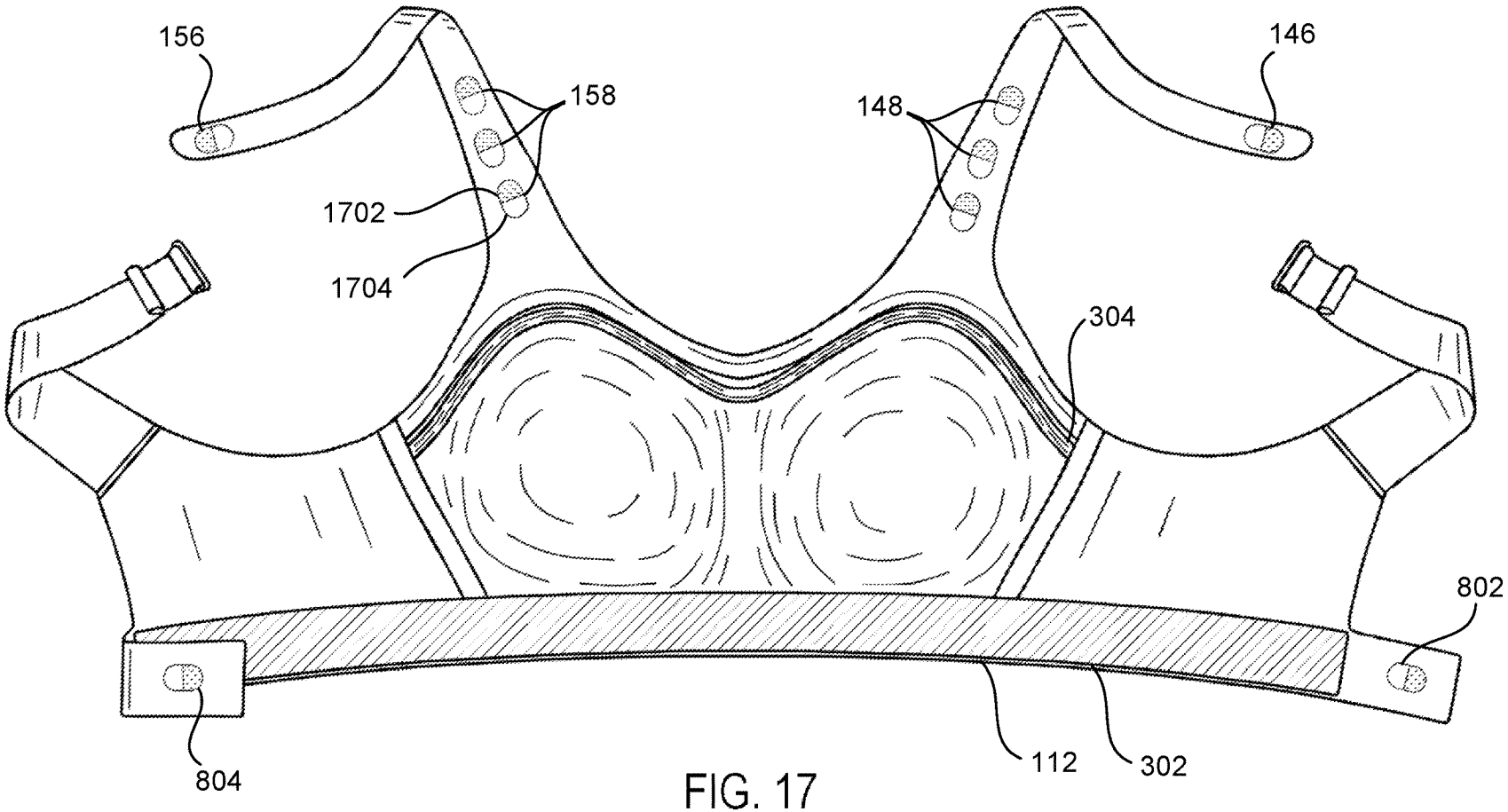
FIG. 17 illustrates a back view of a bra in accordance with an embodiment of the present disclosure.

In various implementations, the bottom portion of the band 102 forms an underband 112. The underband 112 provides support for the breasts of the wearer and dampens movement of the bra 100 during use, but does not provide cantilever support to the breasts like the tessellated cups 120. When the underband 112 is present, it is formed below the channel 108. In some implementations, and as illustrated in at least FIGS. 1 through 5, the underband is formed from a same fabric as the band 102. In other implementations, and as illustrated in FIGS. 6 and 7, the underband 112 is formed from a different fabric than the band 102. The underband 112 has an inner surface, which is in contact with the torso of the wearer during use, and an outer surface with is largely ornamental. The inner surface and the outer surface of the underband 112 are not necessarily of a single layer of fabric, as in some implementations the underband may be formed from a variety of layers of fabric. For instance, as illustrated in FIG. 17, in some implementations the outer surface is of one type of fabric and the inner surface (e.g., surface 302) is of another type of fabric.

In some implementations, and as illustrated in at least FIG. 3, a first textile strip 302 is attached to a portion of the inner surface of the underband 112. In some implementations, the first textile strip 302 is formed from a material that is configured to adhere to a surface when the material is exposed to moisture (e.g., becomes damp). For instance, when the first textile strip 302 becomes damp, either due to moisture in and/or on the first textile strip and/or the torso of the wearer, the first text tile strip becomes adhesive and adheres to the torso. This dampening of the first textile strip is repeated such that the textile strip may be dampened and dried a plurality of times without hindering the adhesive properties of the material. This adhesion imparted by the first textile strip 302 ensures that the bra 100 remains in place during activities of perspiration (e.g., sports and stress) without leaving residue on the user or providing discomfort (e.g., chafe or abrade) to the wearer. In some embodiments, the first textile strip includes Stay4Sure (e.g., nano-elastic) silicon coating as provided by Stretchline Holdings 1430 Broadway Suite 307, New York, N.Y. 10018 U.S.A. In some implementations, the first textile strip 302 is between 0.5 centimeters (cm) and 3 cm wide. In some implementations, the first textile strip 302 is between 0.5 cm and 2.5 cm wide. In some implementations, the first textile strip 302 is between 0.25 cm and 2.0 cm wide. In some implementations, the first textile strip 302 is as wide as the underband 112. In some implementations, the first textile strip 302 is half as wide as the underband 112. In some implementations, the first textile strip 302 is a quarter as wide as the underband 112. In some implementations, the first textile strip 302 is as wide as the bottom portion of the band 102. Moreover, in some implementations, the first textile strip 302 spans a length that is approximately equal to a length of the underband 112. In some implementations, the first textile strip 302 spans a length that is approximately equal to three-quarters of the length of the underband 112. In some implementations, the first textile strip 302 spans a length that is approximately equal to half of the length of the underhand 112. In some implementations, the first textile strip 302 is divided into at least a first portion which spans a first length of the underhand 112 and a second portion which spans a second length of the underband.

In various implementations, and as illustrated in at least FIG. 3, a second textile strip 304 is affixed (e.g., sewn or bonded) to an upper portion of the band 102. As used herein, the upper portion of the band 102 includes the single inner pad layer 306 and/or each cup region (104, 106). For instance, in some implementations a portion of the single inner pad layer 306 interrupts the second textile strip 304 to create discrete portions of the second textile strip 304 that correspond to each cup region (104, 106). In some implementations, the second textile strip 304 is formed of a fabric that has similar dampening and adhesion properties as previously described in relation to the first textile strip 302, but is not the same fabric as the first textile strip 302. In other implementations, the second textile strip 304 is formed of a fabric that has similar dampening and adhesion properties as previously described in relation to the first textile strip 302, and is the same fabric as the first textile strip 302. In some implementations, the second textile strip 304 is between 0.5 cm and 2.0 cm wide, between 0.25 cm and 1.0 cm wide, between 0.5 cm and 1.5 cm wide, or between 0.2 cm and 2.0 cm wide. In some implementations, the second textile strip 304 has a width that is sufficient to span from an edge portion of the band 102 to a portion of each cup region (104, 106). In some implementations, a distance from the second textile strip 304 to the edge of the band 102 is between 0.5 centimeters (cm) and 2.0 cm wide. In some implementations, the distance from the second textile strip 304 to the edge of the band 102 is between 0.25 cm and 3.0 cm wide. In some implementations, the distance from the second textile strip 304 to the edge of the band 102 is between 0.5 cm and 2.5 cm wide. In some implementations, the distance from the second textile strip 304 to the edge of the band 102 is between 0.25 cm and 1 cm wide. In some implementations, the second textile strip 304 has a length that spans a length of combined cup regions (104, 106).

Figure 9:
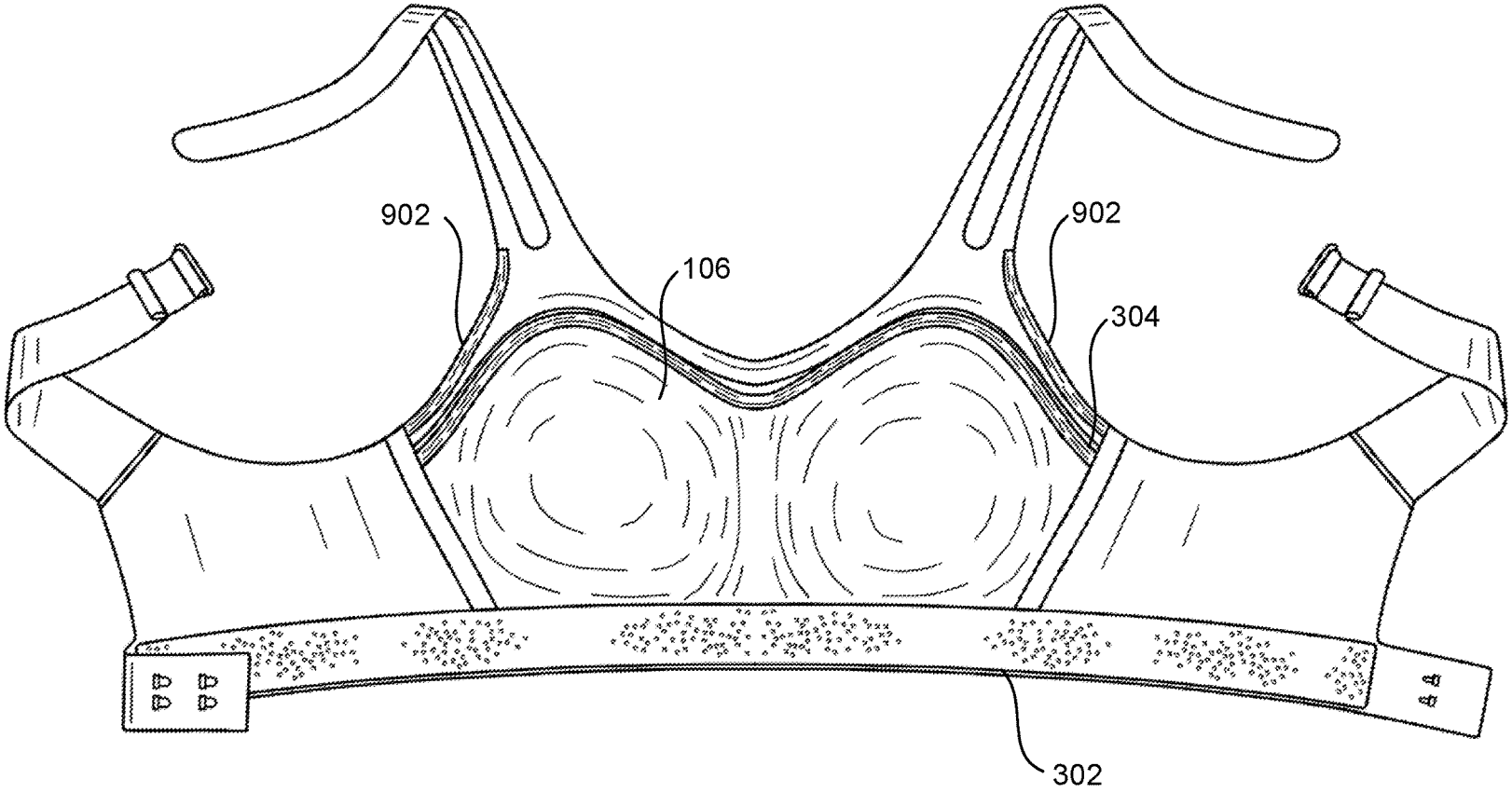
FIG. 9 illustrates a back view of another bra in accordance with an embodiment of the present disclosure.

In various implementations, and as illustrated in FIG. 9, a third textile strip 902 is affixed (e.g., sewn or bonded) to the inner facing surface (e.g., towards the wearer in-use) of the band 102. This inner facer surface is on an upper portion of the band 102, which is above both each of the cup regions (104,106). In some implementations, the third textile strip 902 is formed of a fabric that has similar dampening and adhesion properties as previously described in relation to the first textile strip 302, but is not the same fabric as the first textile strip 302. In other implementations, the third textile strip 902 is formed of a fabric that has similar dampening and adhesion properties as previously described in relation to the first textile strip 302, and is the same fabric as the first textile strip 302. Moreover, in some implementations, the third textile strip 902 is formed of a fabric that is similar to the first second strip 304, but is not the same fabric as the first second strip 304. In other implementations, the third textile strip 902 is formed of a fabric that is to the second textile strip 302, and is the same fabric as the second textile strip 302. In some implementations, the third textile strip 902 is between 0.5 centimeters (cm) and 2.0 cm wide, between 0.25 cm and 1.0 cm wide, between 0.5 cm and 1.5 cm wide, or between 0.2 cm and 2.0 cm wide. In some implementations, the third textile strip 902 has a width that is sufficient to span from an edge portion of the band 102 to a portion of each cup region (104, 106). In some implementations, a distance from the third textile strip 902 to the edge of the band 102 is between 0.5 cm and 2.0 cm. In some implementations, the distance from third textile strip 902 to the edge of the band 102 is between 0.25 cm and 1.0 cm. In some implementations, the distance from the third textile strip 902 to the edge of the band 102 is between 0.5 cm and 0 cm (e.g., on the edge). In some implementations, the distance from the third textile strip 902 to the edge of the band 102 is between 0.1 cm and 0.5 cm. In some implementations, the third textile strip 904 is as wide as the second textile strip 304. In some implementations, the third textile strip 904 has a width that is sufficient to leave a gap between the third textile strip 904 and the second textile strip 304. In some implementations, the gap between the third textile strip 904 and the second textile strip 304 is between 0.1 cm and 1 cm.

These various textile strips (302, 304, and 902) in combination with the tessellated cups 120 provide extraordinary comfort to the wearer during high impact activities such as sports. For instance, the various textile strips (302, 304, and 902) ensure that the bra 100 is stabilized against the torso, while the tessellated cups 120 enable individual movement of the breasts.

Referring to FIGS. 10 through 14, in various implementations, the bottom portion of the underband 112 includes an interruption (e.g., interruption 1002) that has a first side and a second side. A gusset 1000 is bonded to the first side and the second side of the interruption, which reunites the underband 112. In some implementations, a distance between a point on the first side of the interruption 1002 and a point on the second side of the interruption 1002 is between one centimeter (cm) and nine cm. In some implementations, the distance between the point on the first side of the interruption 1002 and the point on the second side of the interruption is between two cm and seven cm, between three cm and six cm, between four cm and five cm, or between two cm and five cm.

A gusset 1000, as used herein, is a component of the bra that is intentionally weakened to relieve stress formed in areas surrounding the gusset. The gusset 1000 allows for slight breast movement to give the wearer a natural feeling while wearing the bra 100, but also prevents the bra from moving as a while unit when the wearer is active. In some implementations, the intentional weakening is provided by utilizing materials with different Young's moduli. The Young's modulus is utilized to measure a stiffness of a solid, or approximately solid, material as determined by an experienced stress and strain via a uniaxial deformation of the material. A smaller Young's modulus (e.g., a number closer to zero) describes a material with a low stiffness (e.g., a high extensibility such as small strain rubber which has a Young's modulus of approximately 0.01 to 0.1 Giga-Pascal's (GPa)), while a larger Young's modulus (e.g., a number further from zero) describes a material with a high stiffness (e.g., a low extensibility such as diamond which has a Young's modulus of approximately 1050 to 1210 GPa). For instance, low-density polyethylene has a Young's modulus of approximately 0.11 to 0.86 GPa, nylon has a Young's modulus of approximately 2 to 4 GPa, foam polystyrene has a Young's modulus of approximately 0.0025 to 0.007 GPa, hemp fiber has a Young's modulus of approximately 35 GPa, polyethylene terephthalate (PET) has a Young's modulus of approximately 2 to 2.7 GPa, and polypropylene has a Young's modulus of approximately 1.5 to 2 GPa, to name a few. In some implementations the gusset 1000 has a Young's modulus that is lower than a surrounding fabric (e.g., the fabric of the underband 112 or the band 102). In some implementations, the gusset 1000 has a Young's modulus that is greater than a surrounding fabric (e.g., the fabric of the underhand 112 or the band 102). However, the present disclosure is not limited thereto.

In some implementations the intentional weakening in the gusset 1000 is provided by a process of inducing a stress at a predetermined portion of the bra 100. In some implementations, the stress is a physical stress such as a tensile stress, a compressive stress, a shear stress, or a combination thereof. In some implementations, the stress is a material stress such as a predetermined deterioration (e.g., wearing away or abrasion) of the material of the bra 100. In some implementations, the intentional weakening is provided by a process of subjecting a portion of the bra 100 to a heat treatment process of a chemical treatment process.

In some implementations, the gusset 1000 is formed in a portion of the underband 112 that is below the back portion of the band 102. Likewise, in some implementations, the gusset 1000 is formed in a portion of the back portion of the band 102. Additionally, in some implementations the gusset 1000 is formed in a portion of the underband 112 that is below either underarm portion of the band 102. In some implementations, a respective gusset 1000 is formed in the portion of the underband 112 that is below each underarm portion of the band 102. In some implementations, the underband 112 is formed of a first elastic blend, that has a first percent extensibility (e.g., 10 percent) when placed under a first strain (e.g., a longitudinal strain, latitudinal strain, or a combination thereof), and the gusset 1000 is formed of a second elastic blend that has a second percent extensibility (e.g., 20 percent) when placed under the first strain. The extensibility of a material refers to a measure of an ability of a fabric to stretched, or elongated, under a tensile load. The larger the extensibility of a fabric, the more extensible the fabric is. Additional information regarding material engineering and extensibility is found in Zupin et al., 2010, "Mechanical Properties of Fabrics Made from Cotton and Biodegradable Yarns Bamboo, SPF, PLA in Weft," Woven Fabric Engineering, print, which is hereby incorporated by reference in its entirety. The second percent extensibility is greater than the first percent extensibility, which allows for the gusset 1000 to deform according to a fit of the wearer. For instance, in various implementations, such as the pull-on bra 100 (e.g., bra 100 of FIGS. 18 and 19), the gusset 1000 elastically deforms to stretch and expand a circumference of the band 102 and/or the underband 112, allowing the wearer to put on the bra 100 without discomfort. In some implementations, the second percent extensibility is ten percent greater than the first percent extensibility, fifteen percent greater than the first percent extensibility, twenty percent greater than the first percent extensibility, twenty-five percent greater than the first percent extensibility, thirty percent greater than the first percent extensibility, thirty-five percent greater than the first percent extensibility, forty percent greater than the first percent extensibility, forty-five percent greater than the first percent extensibility, fifty percent greater than the first percent extensibility, fifty-five percent greater than the first percent extensibility, sixty percent greater than the first percent extensibility, or sixty-five percent greater than the first percent extensibility. Moreover, in some embodiments the first blend of the underband 112 is the same as the second blend of the gusset 1000.

Figure 10:
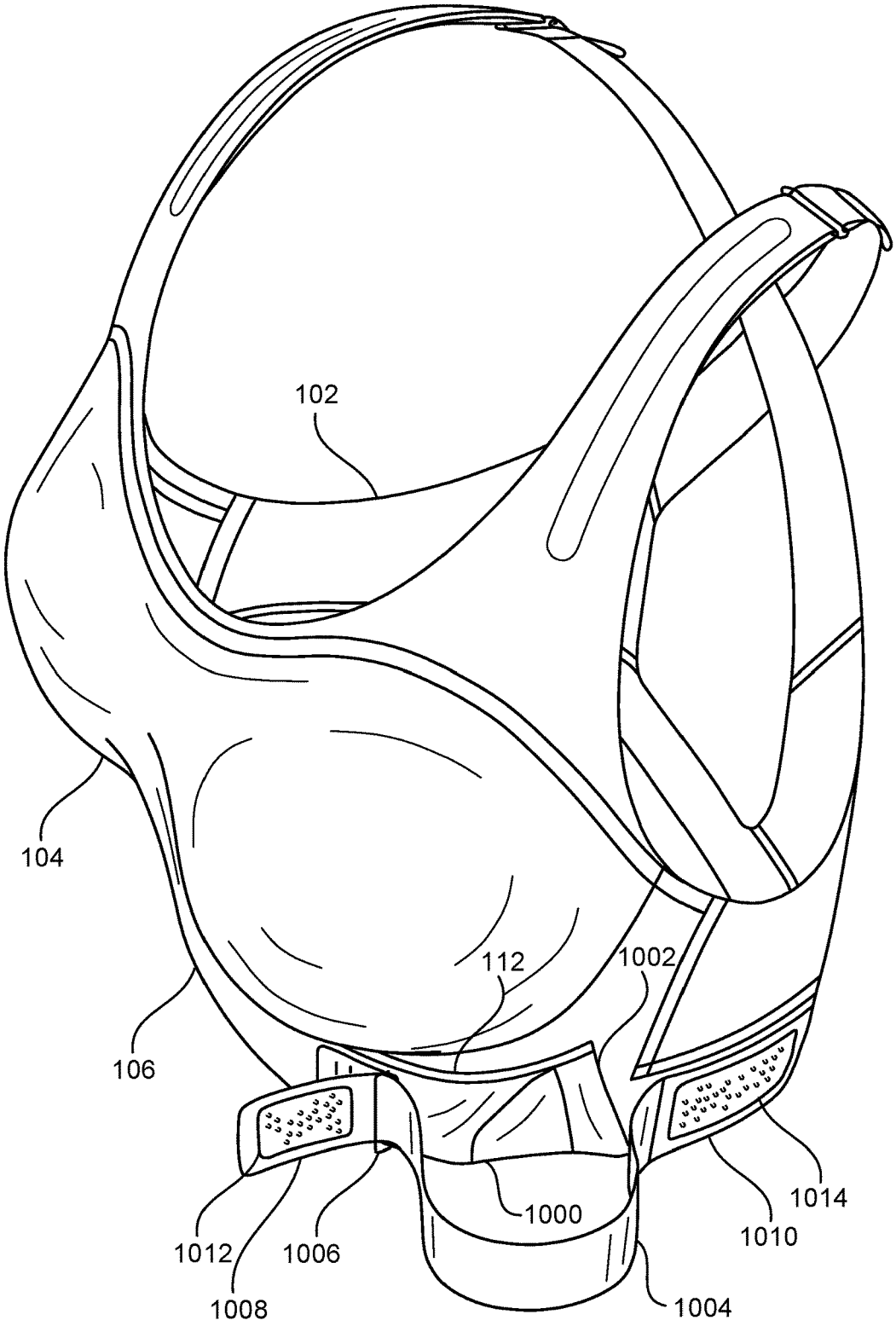
FIG. 10 illustrates a partial side view of yet another bra with a strap, an interruption, and a gusset in accordance with an embodiment of the present disclosure.
Figure 11:
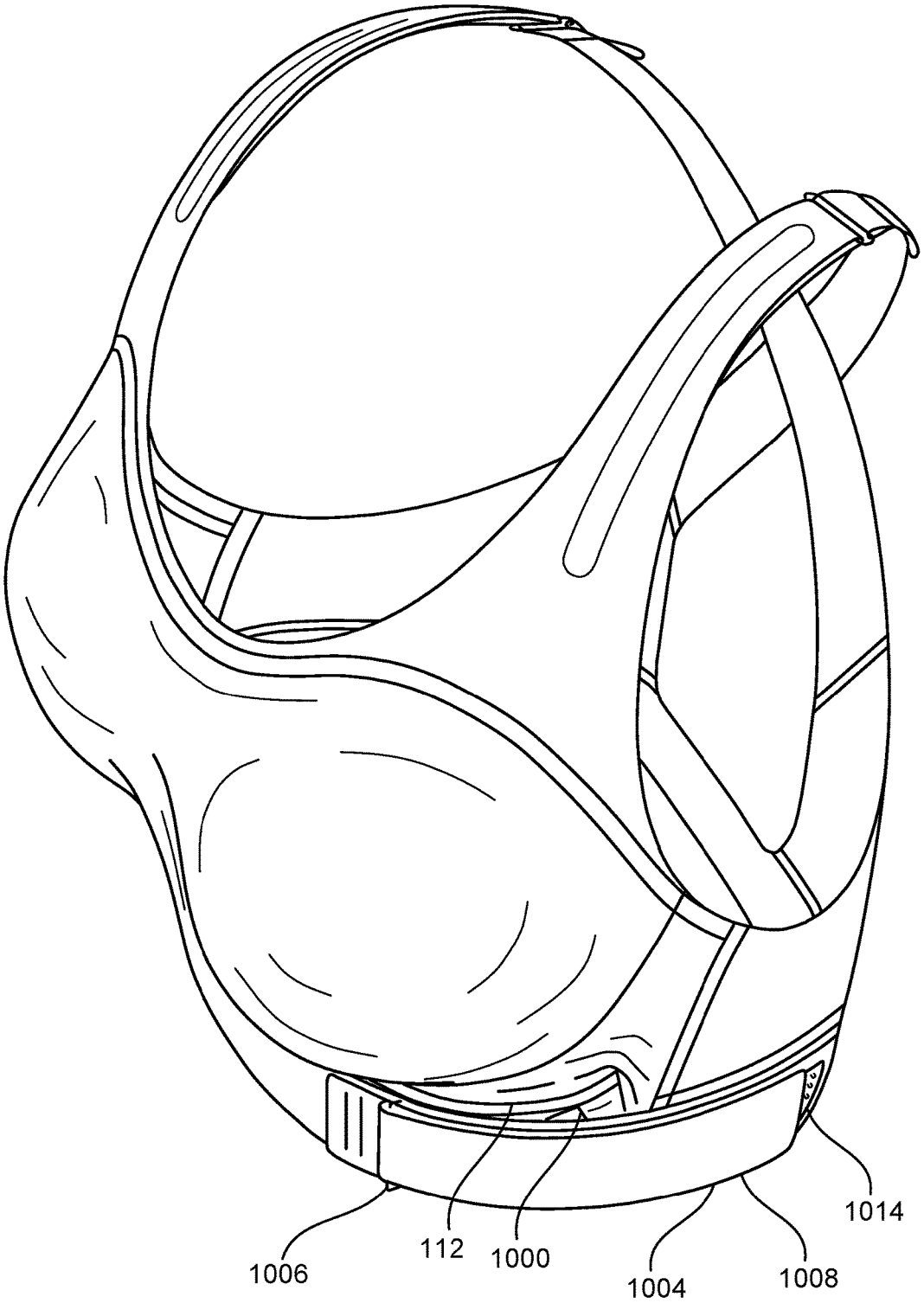
FIG. 11 illustrates another partial side view of the bra of FIG. 10.
Figure 12:
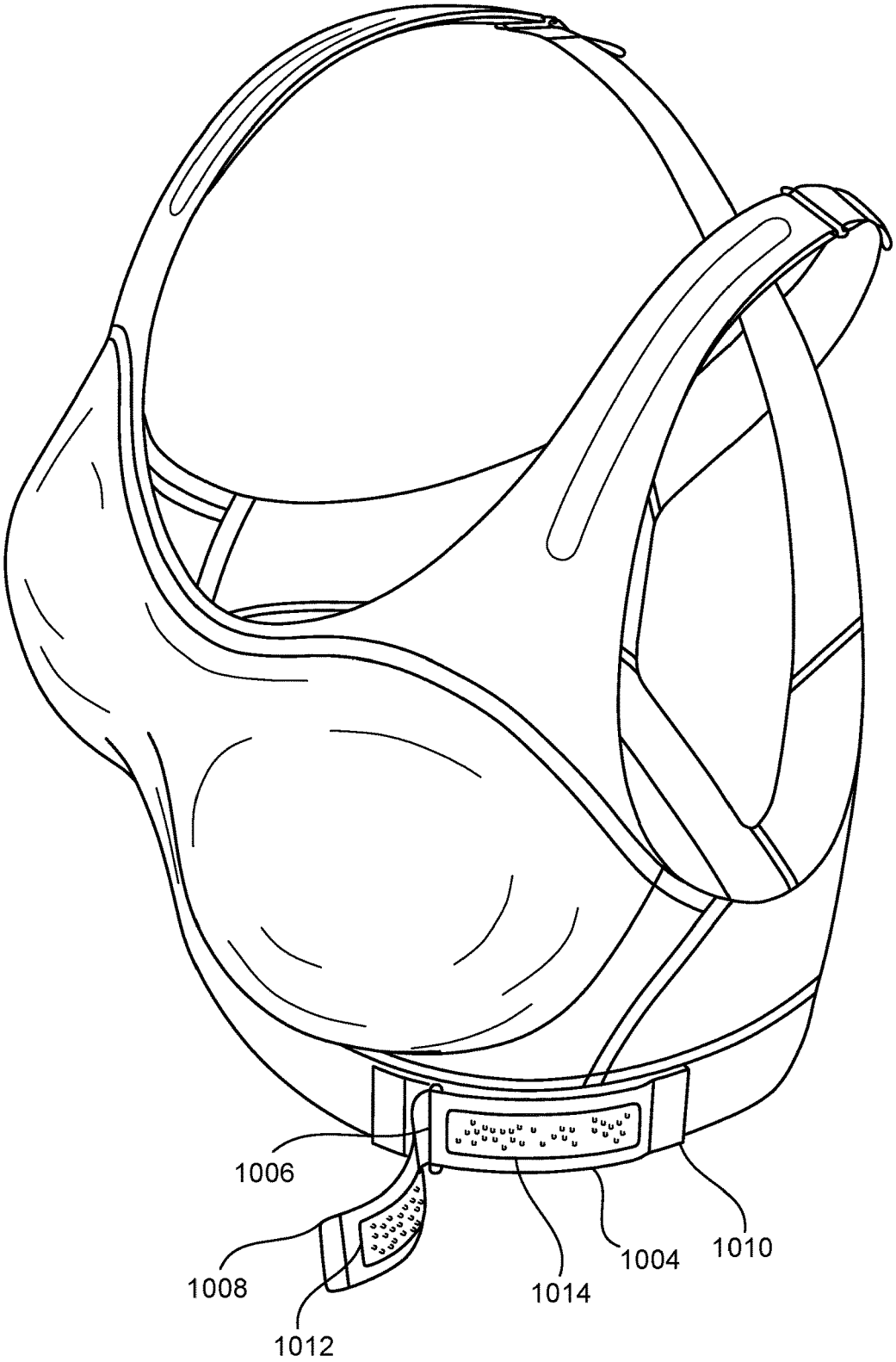
FIG. 12 illustrates a partial side view of a bra with a strap in accordance with an embodiment of the present disclosure.
Figure 13:
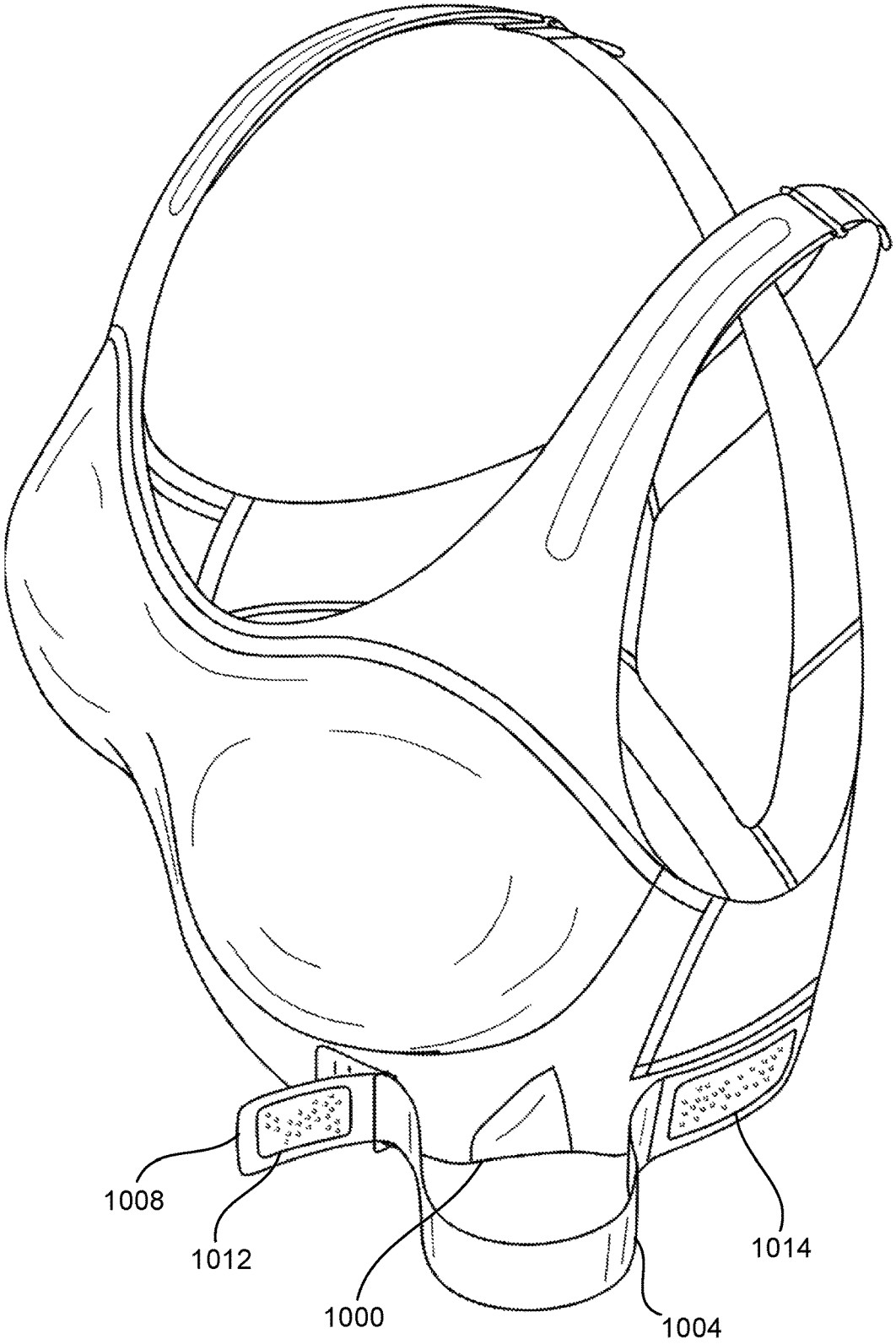
FIG. 13 illustrates a partial side view of a bra with a strap and a gusset in accordance with an embodiment of the present disclosure.
Figure 14:
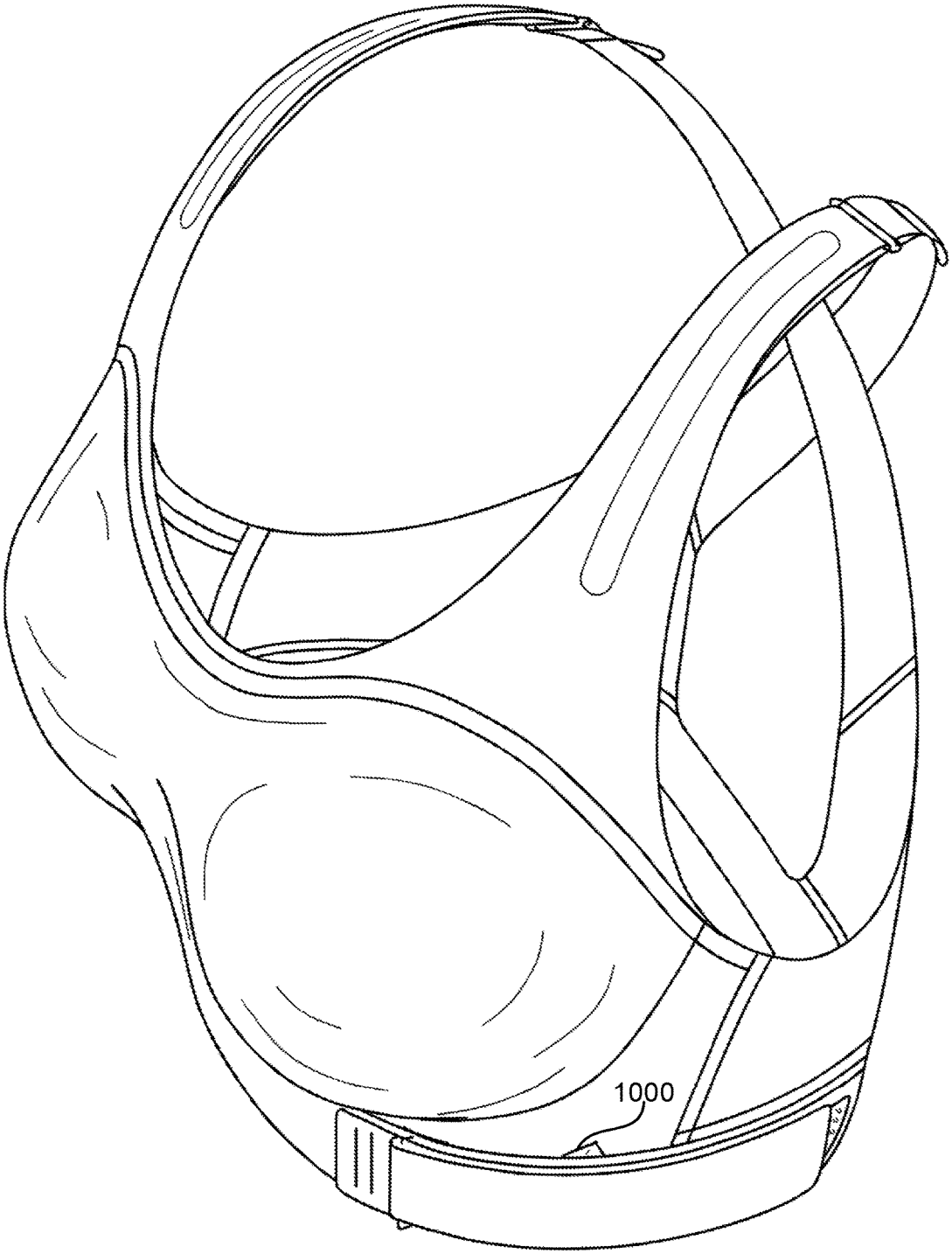
FIG. 14 illustrates another partial side view of the bra of FIG. 13.

In various implementations, the underband 112 has a first width that is perpendicular to a length of the first elastic blend of the underband 112. Accordingly, the gusset 1000 has a variable width that runs along the length of the first elastic blend of the underhand 112, and that tapers between the first width at the first side of the interruption 1002 and is less than the first width at the second side of the interruption 1002. In some implementations, the gusset 1000 has a width that is greater than a centimeter at the first side of the interruption 1002 and a width that is less than a centimeter at the second side of the interruption. In some implementations, the gusset 1000 has a width that is greater than 1.3 centimeters at the first side of the interruption 1002 and a width that is less than 0.3 centimeters at the second side of the interruption. In some implementations, the gusset 1000 is formed in an approximately triangular shape as illustrated in FIG. 10. In some implementations, the gusset 1000 is formed in an approximately quadrilateral shape.

Referring to FIG. 10, in various implementations, the bra 100 includes a first strap 1004 that is bonded, or sewn, to a first position on the underband 112. In some implementations, the first strap 1004 is bonded to a first position on the band 102. This first position is proximate to the first side of the interruption 1002, which is adjacent to the gusset 1000. A strap loop 1006 is secured to a second position on the underhand 112, and receives an end portion of the first strap 1004 that is not bonded to the underband. This second position is proximate to the second side of the interruption 1002. A touch fastener component 1012 has a first backing member 1008 that supports a first plurality of engagement elements, which extend from one surface of the first backing member. Moreover, the first backing member 1008 is bonded, or sewn, to a terminal face (e.g., an end portion of a face) of the first strap 1004. A mating touch fastener component 1014 includes a second backing member 1010 that supports a second plurality of engagement elements. This second backing member 1010 is bonded, or sewn, to a third position of the underband 112. Similarly, in some implementations the second backing member 1010 is bonded, or sewn, to either the band 102 or the first strap 1004. This third position of the underband 112 is proximate to the first position of the underhand 112 and away from the gusset 1000. Accordingly, the strap 1004 is configured to loop through the strap loop 1006 so that the first plurality of engagement elements engages a subset of the second plurality of engagement elements. Moreover, this engagement enables the touch fastener component 1012 to releasably fasten to the mating fastener component 1014, which adjusts a tightness of the underhand 112 and/or the band 102 on the torso of the wearer. For instance, with reference to FIG. 11, in some implementations the tightness of the underband 112 and/or the band 102 is adjusted to ensure a tight or snug fit around the torso of the wearer. Likewise, the tightness of the underband 112 and/or the band 102 may be released to allow the wearer to easily remove the bra 100.

In various implementations, the mating fastener 1014 of the second backing member 1010 is formed with a longer length than the touch fastener 1012 of the first backing member 1008. For instance, in some implementations a length of the mating fastener 1014 is at least 5 centimeter (cm) while a length of the touch fastener 1012 is at least 1 cm. In some implementations, the length of the mating fastener 1014 is at least 10 cm while the length of the touch fastener 1012 is at least 2 cm. In some implementations, the length of the mating fastener 1014 is at least 4 cm while the length of the touch fastener 1012 is at least 0.5 cm. In some implementations, the length of the mating fastener 1014 is at least 5 cm while the length of the touch fastener 1012 is at least 1 cm. In some implementations, the length of the mating fastener 1014 is at least 6 cm while the length of the touch fastener 1012 is at least 0.5 cm. In some implementations, the length of the mating fastener 1014 is at least 10 cm while the length of the touch fastener 1012 is at least 5 cm. In some implementations, the length of the mating fastener 1014 is at least double the length of the touch fastener 1012. In some implementations, the length of the mating fastener 1014 is at least four-times the length of the touch fastener 1012. In some implementations, the length of the mating fastener 1014 is at least ten-times the length of the touch fastener 1012. In some implementations, the length of the mating fastener 1014 is at least a quarter of a circumference of the band 102, or the underband 102. In some implementations, the length of the mating fastener 1014 is at least a fifth of the circumference of the band 102, or the underband 102. In some implementations, the length of the mating fastener 1014 is at least a tenth of the circumference of the band 102, or the underband 102. This difference in length between the fasteners (1012, 1014) enables a length of the strap 1004, or the underband 112 and/or the band 102 by way of the strap 1004, to be adjusted with a wider range adjustability. The greater the length of the mating fastener 1014, the greater then possible range of adjustment can be utilized using the strap 1004 and corresponding touch fastener 1012. For instance, conventional hook-eye fasteners are limited in range by the number of eyes and hooks, whereas the fasteners of the present disclosure have no such limitations. Moreover, having a shorter touch fastener 1012 reduces a risk of having the touch fastener misaligned with the mating fastener 1014, which may cause discomfort to the wearer of the bra 100. Additionally, in various implementations this different of length between the mating fastener 1014 and the touch fastener 1012 allows for the entire touch fastener 1012 to engage only a portion of the mating fastener 1014.

In various implementations, an intermediate member interconnects and isolates the first backing member 1008 from the terminal face of the first strap 1004. Similarly, another intermediate member interconnects and isolates the second backing member 1010 from the underband 112, or the band 102. When uncoupling the touch fastener 1012 from the mating fastener 1014, vibrations (e.g., sound waves) propagate through the various materials of the fasteners (1014, 1012) and the bra 100, which in turn produces an amplified vibration, or wave. The various materials of the fasteners (1014, 1012) and the bra 100 act as amplifier for the vibrations to produce any audible noise. These intermediate members are configured to reduce the noise that is generated when the touch fastener component 1012 is disengaged from the mating touch fastener component 1014, by dampening and dissipating these vibrations before the vibrations propagate through the fasteners (1014, 1012) and the bra 100. This dampening ability is realized through both macroscopic properties of the material (e.g., a thickness of the material and a shape of the material) and the mechanical properties of the material (e.g., a porosity of the material or an elasticity of the material). In various implementations, the first intermediate member and the second intermediate member each includes a spandex material, an elastomeric material, a non-woven material, a braided material, a foam material, or a diamond mesh material. In some implementations, the diamond mesh material is formed with threads, or fibers, that align at or between an angle of 30° to 60° from an edge portion of the intermediate member. The material of the intermediate members is selected according to its dampening ability.

In various implementations, the first backing member 1008 and the second backing member 1010 each include an elastic material (e.g., spandex or rubber). The touch fastener 1012 is formed from a knitted material (e.g., cotton or wool) that includes a first plurality of loops. In some implementations, the plurality of loops is formed with a density of at least one hundred loops per square inch. In some implementations, the plurality of loops is formed with the density of at least 500 loops per square inch. In some implementations, the plurality of loops is formed with the density of at least 750 loops per square inch. In some implementations, the plurality of loops is formed with the density of at least 1000 loops per square inch. In some implementations, the plurality of loops is formed with the density of at least 2000 per square inch.

The first plurality of engagement elements is formed from a subset of the first plurality of loops by disrupting the subset of the first plurality of loops. In some implementations, the subset of the first plurality of loops is physically separated from the plurality of loops. However, the present disclosure is not limited thereto. For instance, in some implementations the subset of the first plurality of loops is a first subset in a plurality of subsets of the first plurality of loops.

The disruption of each loop in the subset of loops forms a corresponding engagement element, which is of the first plurality of engagement elements. In some implementations, the disruption of each loop in the subset of loops forms a set (e.g., a pair) of corresponding engagement elements. In some implementations, the disruption that forms the engagement elements is a process of repeatedly engaging the subset of loops with a sheet of material (e.g., a sheet of carbon, a sheet of glass, a sheet of sand paper). The repeated engagement is conducted in such a way that the subset of loops and the sheet of material engage (e.g., create friction between one another), in a single direction (e.g., the sheet of material repeatedly traverses the subset of loops in a single direction). In some implementations, the one direction is either a linear motion or a rotational motion. This single direction engagement ensures that the mircohooks are formed with a similar orientation, which provides a smooth texture for the wearer of the bra. However, the present disclosure is not limited thereto. For instance, in some implementations the repeated engagement is conducted in such a way that the subset of loops and the sheet of material engage (e.g., create friction between one another), in one or more directions (e.g., the sheet of material repeatedly traverses the subset of loops in a first direction and a second direction).

In various implementations, each engagement element is in the form of a microhook. These microhooks may be formed as an arc, in a J-shape, in a mirrored J-shape, in a partial U-shape (e.g., there is a gap forming an interruption in the U-shape), in a partial V-shape (e.g., there is a gap forming an interruption in the V-shape), or a combination thereof. Moreover, in some implementations, each engagement element is formed in a shape that is approximately similar to a shape of a fishing-hook (e.g., a bait hook, a circle hook, a treble hook).

The mating fastener 1014 is formed from a knitted material (e.g., cotton or wool) that includes a second plurality of loops. In some implementations, the knitted material of the mating fastener 1014 is the knitted material of the touch fastener 1012. However, in various implementations, the knitted material of the mating fastener 1014 is different than the knitted material of the touch fastener 1012. These knitted materials of the touch fastener and the mating fastener include, but are not limited to, cotton, wool, plastics, as other fabrics as described in the present disclosure.

This second plurality of loops serve as the second plurality of engagement elements. (e.g., the second plurality of loops engage the first plurality engagement elements). When the touch fastener 1012 and the matching fastener 1014 engage, individual loops in the second plurality of loops reversibly engage with individual engagement elements (e.g., microhooks) in the first plurality of engagement elements. In some implementations, each fastener is formed in a way that is as described by U.S. Pat. No. 4,884,323 "Quite Touch Fastener Attachment," which is herein incorporated by reference in its entirety.

In various embodiments, the touch fastener 1012 and the mating fastener 1014 are each magnetized. These magnetized fastener implementations will be described in more detail infra, and particularly with respect to FIG. 17.

While the above implementations describe the strap 1004 on one side of the underband 112, or the band 102, the present disclosure is not limited thereto. For instance, in some implementations, there is a corresponding strap 1004 for each gusset 1000 on the underband 112, or the band 102, of the bra 100. In other implementations, there is a corresponding strap 1004 for each underarm portion of the band 102.

Figure 16B:
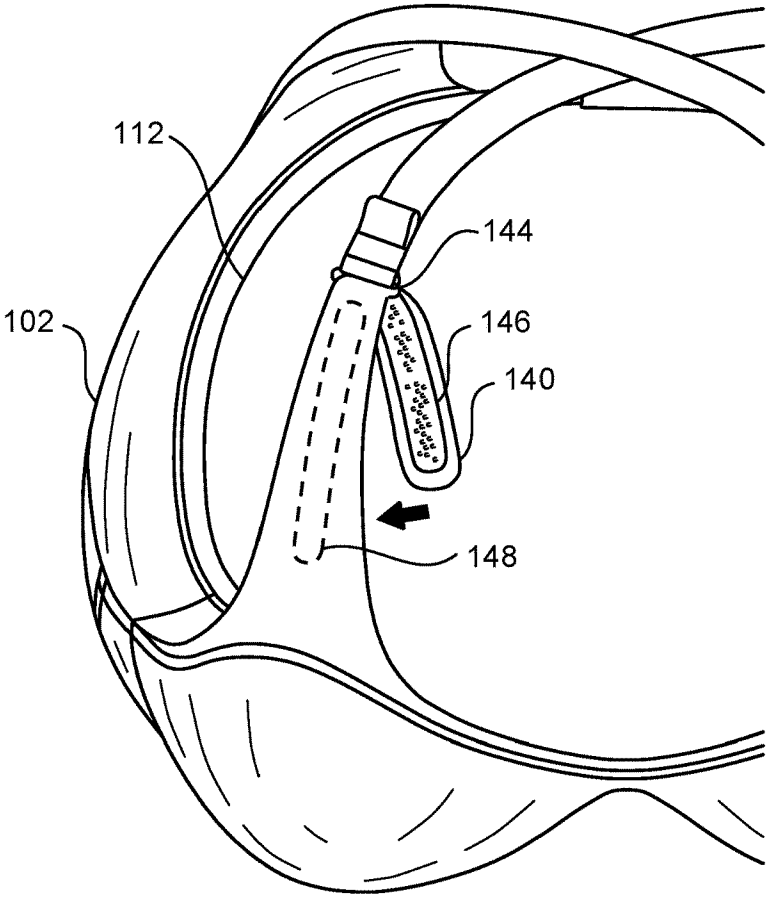
FIGS. 16A, 16B, and 16C illustrates an operation of another strap of a bra in accordance with an embodiment of the present disclosure.
Figure 16A:
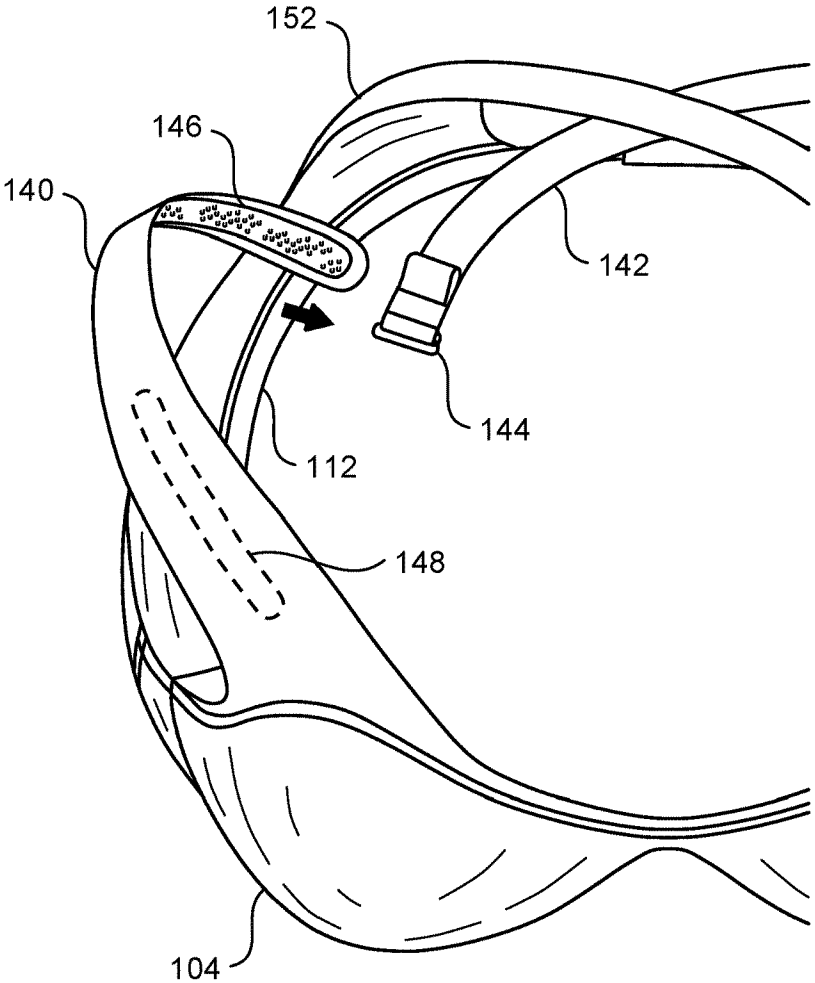
Figure 16C:
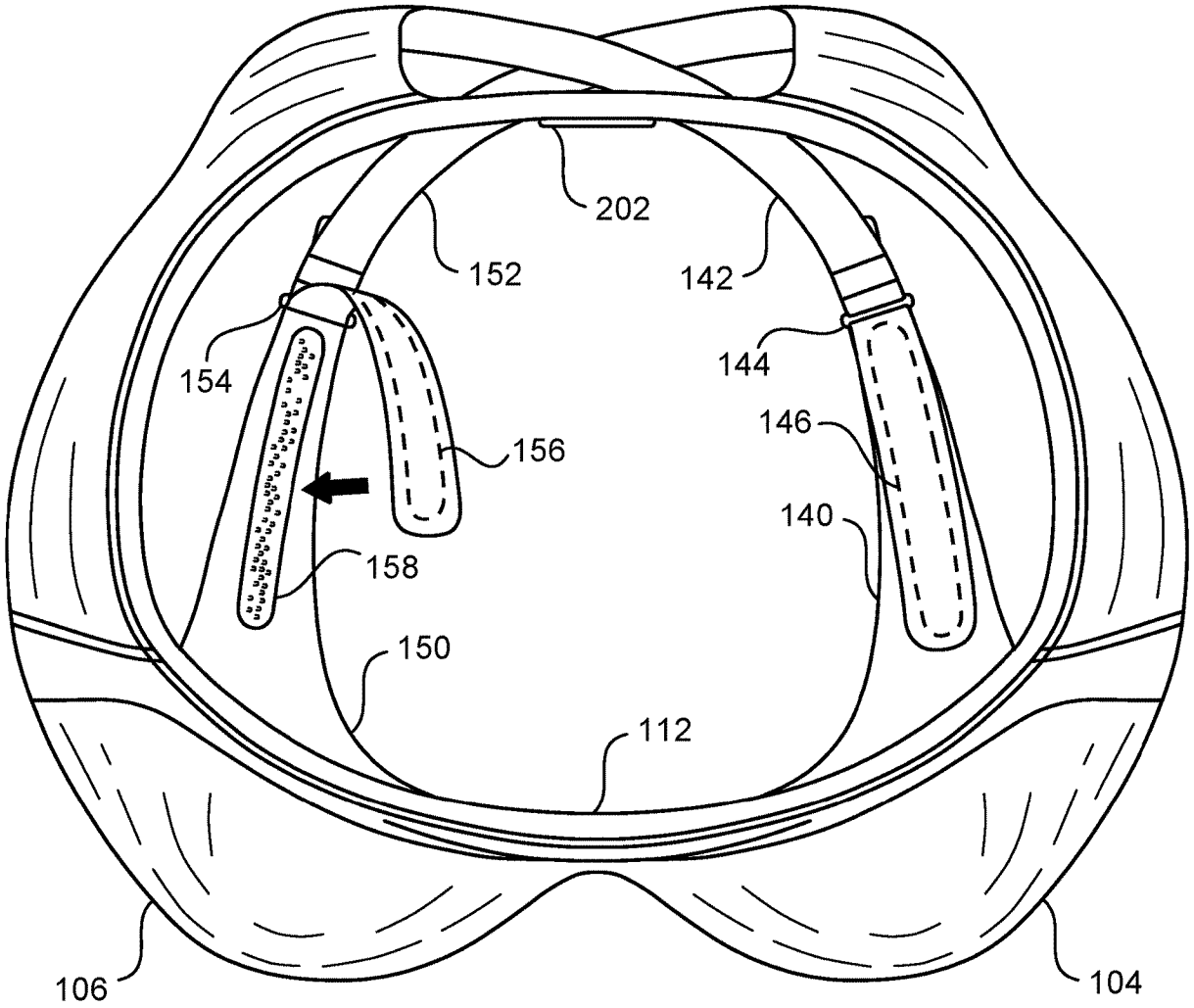

In various implementations, and as illustrated in at least FIG. 16, the bra 100 further includes a shoulder strap. The shoulder strap corresponds to an arm portion of the wearer, and in some implementations provides support for the breasts of the wearer. However, in other implementations the shoulder strap of the bra is largely ornamental and provides no significant support for the breasts of the wearer. In some implementations, each arm portion of the wearer (e.g., each underarm portion of the band 102) includes the shoulder strap. In other implementations, only one underarm portion of the band 102 includes a shoulder strap. While the Figures of the present disclosure illustrate should straps that cross at the back portion of the band 102, the present disclosure is not limited thereto. For instance, in some implementations the shoulder straps cross at the front portion of the band 102, and in other implementations the shoulder straps to not cross. Nevertheless, each shoulder strap includes a first shoulder strap (e.g., a first left shoulder strap 150 or a first right shoulder strap 140), which adjoins one of a corresponding cup region (e.g., cup region 104 or 106) and a first portion of the back portion of the band 102 (e.g., strap 140 which adjoins the cup region 104, whereas strap 150 adjoins cup region 106). Additionally, each shoulder strap includes a second shoulder strap (e.g., a second left shoulder strap 152 or a second right shoulder strap 142) adjoining the corresponding cup region (104, 106) and the first portion of the back portion of the band 112 (e.g., strap 142). A touch fastener component (146, 156) has a first backing member that is bonded, or sewn, to a terminal face of the first shoulder strap (140, 150), and supports a first plurality of engagement elements. These engagement elements extend from one surface of the first backing member (e.g., a surface that faces away from the wearer of the bra), and the first backing member is bonded, or sewn, to a terminal face of the first shoulder strap (e.g., first right shoulder strap 140, first left shoulder strap 150). A mating touch fastener component (e.g., mating fastener 148 of the second right strap 142 or mating fastener 158 of the second left strap 152) includes a second backing member that supports a second plurality of engagement elements. The second backing member is bonded, or sewn, to a base position of the first strap (e.g., first right strap 140 or first left strap 150) on the same side as the respective touch fastener component (146, 156). A strap loop is secured to a terminal position of the second strap (e.g., strap loop 144 is secured to second right strap 142, strap loop 154 is secured to second left strap 152). This strap loop (144, 154) is configured to receive and loop through the corresponding first straps (e.g., the first right strap 140 loops through the strap loop 144 which is coupled to the second right strap 142, or the first left strap 150 loops through the strap loop 154 which is coupled to the second left strap 150). In some implementations, each strap loop (144, 154) is secured to a terminal position of the first strap (140, 150) such that the engagement process as described to one strap is translated to the other corresponding strap.

Nevertheless, each strap loop (144, 155) enables the first plurality of engagement elements to engage a subset of the second plurality of engagement elements, which releasably fastens the touch fastener component (146, 156) to the corresponding mating fastener component (148, 158). As previously described in relation to the strap 1004, this looping allows for the wearer to individually adjust a tightness of each shoulder strap.

In various embodiments, each touch fastener (146, 156) has a length that is shorter than a length of the corresponding mating fastener (148, 158). As previously described, this difference in length of the respective fastening members allows for the touch fastener (146, 156) to engage the corresponding matching fastener (148, 158) at a variety of positions in a widely adjustable manner. For instance, if the wearer wants a looser fit (e.g., when putting on or pulling off the bra) the touch fasteners (146, 156) may engage the corresponding mating fasteners (148, 158) at a position that is proximate to the corresponding loop straps (144, 154), which provides a maximum length for the respective second straps (e.g., second straps 142, 152). Further, since each wearer of a bra 100 has a different length of torso and a different personal preference for a fit of the bra, the wide range of adjustability of the fasteners allows wearer to adjust the bra for both intense, high impact activities such as sports while also being adjustable for causal, low impact activities such as office work.

In various implementations, and as illustrated in at least FIG. 17, each fastener portion (e.g., touch fasteners 146, 156 and mating fasteners 148, 158) is magnetized. Moreover, in some implementations, the clasp 202 and its corresponding fixtures (802, 804) are magnetized. In such implementations, and further magnetization implementations of the present disclosure, the fasteners (146, 148, 156, 158, 802, and 804) are embedded within various respective portions of the bra 100. In other implementations, the fasteners (146, 148, 156, 158, 802, and 804) are disposed on various respective surfaces of the bra 100, and are coated in a protective material. These embedded and coated implementations of the magnets ensure that various washing systems are not damaged while washing the bra 100, while also ensuring that the respective magnets maintain their respective positions on the bra.

In various implementations, each fastener portion of the shoulder straps (e.g., touch fasteners 146, 156 and mating fasteners 148, 158) is magnetized with a corresponding single neodymium magnet. Similarly, in some implementations each fastener portion of the shoulder straps (e.g., touch fasteners 146 and 156, mating fasteners 148 and 158) includes a plurality of neodymium magnets. In some embodiments, each touch fastener (146, 156) is a single neodymium magnet, while each mating fastener (148, 158) includes a plurality of neodymium magnets (e.g., a magnet that corresponds to a small size length of strap, another magnet that corresponds to a medium size or length of strap, and yet another magnet that corresponds to a large size or length of strap). Moreover, in some implementations, the clasp 202 and its corresponding fixtures (802, 804) are each magnetized with a corresponding single neodymium magnet, or in some implementations a plurality of neodymium magnets. In general, the greater the number of magnets associated with each fastener, the greater range of adjustability of the corresponding straps.

In various implementations, each fastener (e.g., touch fasteners 146 and 156, mating fasteners 148 and 158) is magnetized with a corresponding array of neodymium magnets. This array of neodymium magnets is programmed, or arranged, to induce a twist on and twist off releasable attachment effect of the corresponding first strap (140, 150) to the corresponding second strap (142, 152). Moreover, in some implementations the clasp 202 and its corresponding fixtures (802, 804) are each magnetized with a corresponding array of neodymium magnets. For instance, in some implementations each magnet of each fastener is programmed with at least a first polarity 1702 and a second polarity 1704, which are opposite polarities (e.g., a positive and a negative polarity). This configuration of programmed polarities ensures that corresponding fasteners (e.g., touch fastener 146 and mating fastener 148, touch fastener 156 and mating fastener 158) align when engaged, while also providing a sufficient attractive force between the respective fasteners to prevent the magnets from becoming uncoupled accidentally.

Now that a general structures of various implementations of the bras of the present disclosure have been described, various materials of the bra 100 will now be described in detail.

In various implementations, each tessellated cup 120 is formed by liquid lycra painting. Liquid lycra painting is a process which involves spreading, or receiving, liquid lycra in a mold, and allowing the lycra to solidify. Moreover, in some implementations the cradle 130 is formed by liquid lycra painting. Depending on an implementation of the tessellated cups 120, or the cradle 130, the liquid lycra includes between 40 and 95 percent weight volume (w/v) water and between 5-60 percent w/v polyurethane urea. In some implementations, the liquid lycra includes between 40 and 95 percent weight volume (w/v) water and between 5-50 percent w/v polyurethane urea. In some implementations, the liquid lycra includes between 50 and 90 percent weight volume (w/v) water and between 10-50 percent w/v polyurethane urea.

In various implementations, select components of the bra 100 or formed from, or include, a thermoplastic elastomer (TPE). Moreover, in various implementations, select components of the bra 100 or formed from, or include, a thermoplastic rubber or resin (TPR). Components formed may be formed of TPE or TPR include each tessellated cup 120 and the cradle 130. For instance, in some implementations each tessellated cup 120 is formed from a TPE or TPR. In other implementations, the cradle 130 is formed from a TPE or TPR. Moreover, in some implementations, each tessellated cup 120, the gore 110, and the cradle 130 are formed from a TPE or TPR.

In some implementations, the TPR is a styrenic block copolymer. Styrenic block copolymers have a large volume and are considered to be commercially viable (e.g., cheap to produce and fabricate with). In various implementations, the styrenic block copolymers is a blend of other polymers, a variety of oils, and fillers which provides a multitude of different material properties such as a more rigid styrenic block copolymer or a styrenic block copolymers with a larger Young's modulus. When the styrenic block copolymer cools from a liquid to a solid, the material becomes rigid.

In some implementations, the TPR is a thermoplastic polyolefin elastomer such as ethylene-butene or ethylene-octene. These thermoplastic polyolefin elastomer are utilized for portions of the bra which require a certain degree of flexibility.

In some implementations, the TPR is a thermoplastic vulcanizate. These thermoplastic vulcanizates materials are often relatively soft and have an initial bending modulus that is less than or equal to 800 mega Pascal's (MPa).

In some implementations, the TPR is a thermoplastic polyurethane. Like the thermoplastic vulcanizates, thermoplastic polyurethane materials are often relatively soft and have an initial bending modulus that is less than or equal to 500 mega Pascal's (MPa).

Moreover, in some implementations the TPR is a thermoplastic copolyester. Further, in some implementations the TPR is a thermoplastic polyamide.

In various implementations, select components of the bra 100 are formed from an auxetic material. Auxetic materials are defined as having a negative Poisson's ratio (e.g., v is less than 0), which is imparted on the material through microstructures (e.g., cells and/or pores), or geometric units (e.g., a honeycomb geometric unit or a bow-tie geometric unit) in the material. The negative Poisson's ratio means that when a strain (e.g., a tensile strain) is applied to the material, the material expands and becomes fatter in a direction orthogonal to the direction of the applied strain (e.g., a lateral strain forces the auxetic material to expand longitudinally). For instance, if a breasts, which is surrounded by the auxetic material, moves away from its equilibrium position the auxetic material will expand in a direction opposite to the movement of the breast. This expansion in the direction opposite to the motion provides a dampening effect to the breasts and restricts a range of motion of the breasts. In other words, when a force is applied to the auxetic material it becomes stronger as opposed to weaker. These auxetic materials, which are compressible foams, have improved mechanical properties that includes an improved shear modulus, an increased resistance to deformation such as indentations, as well as an increased fracture toughness.

In some implementations the compressible auxetic polymeric foam is formed by undergoing a compression and heat treatment process of a thermoformable polymeric foam. The compression process includes subjecting a conventional foam specimen to a three-dimensional compression (e.g., triaxially) in a mold. In various implementations, the conventional foam is compressed with a volumetric compression ratio (VCR) of from 1.4 to 4. The volumetric compression ratio is defined as an initial volume of the foam divided by a final volume of the foam. In some implementations, once the foam specimen is adequately compressed in the mold (e.g., compressed to a predetermined VCR and/or for a predetermined period of time), the specimen is removed from the mold and partially relaxed or stretched to remove any internal adhesion of cells. The compressed foam specimen is then subjected to a heat treatment for a predetermined period of time in order to soften the foam. In some implementations, this heat treatment is conducted at a temperature of from 100° C. to 200° C. In some implementations, this heat treatment is conducted at a temperature of from 145° C. to 200° C. In some implementations, this heat treatment is conducted at a temperature of from 155° C. to 180° C. In some implementations, this heat treatment is conducted at a temperature of from 163° C. to 171° C. This softening of the foam relaxes any internal stresses formed therein by the compression process, while also setting a shape of the foam. The exact Poisson's ratio of an auxetic foam is determined by processing conditions including a heating time of the material, a conversion temperature of the material during the forming processes, and the volumetric compression ratio of the material during the compression process. The Poisson's ratio of an auxetic material is also related to a number of pores pre inch (ppi) of the material. For instance, auxetic materials with high ppi's (e.g., 60 ppi) tend to have a Poisson's ratio that is closer to zero, whereas auxetic materials with low ppi's (e.g., 10 ppi) tend to have a Poisson's ratio that is closer to −1.

Examples of a thermoformable polymeric foam that is subjected to a compression and heat treatment process includes a G45 polyurethane foam manufactured by the Wm. T Burnett Company, 2112 Montevideo Road, Jessup, Md. 20794. This G45 foam is treated and sold as an auxetic foam by Auxadyne, 200 NE Commercial Drive, Keystone Heights Fla., 32656.

Auxetic foams formed from parent conventional foams have a Young's modulus that is approximately a quarter to a three-quarters of a Young's modulus of the parent foam. For instance, one conventional foam that is transformed into an auxetic foam will have its Young's modulus reduced by approximately 75%. Whereas another conventional foam that is transformed into another auxetic foam will have its Young's modulus reduced by approximately 25%. Additional information regarding the formation and mechanics of auxetic materials is detailed in Chan et. al., 1997, "Fabrication Methods for Auxetic Foams," Journal of Materials Science, (32), p 5945, as well as Allen et. al., 2015, "Auxetic Foams for Sport Safety Applications," Procedia Engineering, (112), p. 104. Each of these references is hereby incorporated by reference in their entirety.

In various implementations, each of the tessellated cups 120 is formed from an auxetic foam. In some implementations, the single inner pad layer 306 is formed from an auxetic foam. In some implementations, the single outer pad layer 1510 is formed from an auxetic foam. These various implementations of the present disclosure may have any of the attributes of auxetic foam previously described supra, as well as any of attributes of auxetic foam that will be described infra.

In some implementations, all or one or more portions of the bra 100 is formed from a suitable material for forming undergarments including auxetic foam, cotton, dacron, elastane, hemp, jute, latex, leather, low melt yarn, lycra, modal, nylon, polyamides, polyester, rayon, spandex, silk, tactel, viscose, wool, yarn, or a combination (e.g., a blend) thereof. For instance, in some implementations a first portion of the bra is formed from a first material (e.g., the underhand and/or the straps 150 are formed from nylon) while a second portion of the bra is formed from a second material (e.g., each tessellated cup region 120 is formed from auxetic foam). In some implementations, various portions of the bra 100 includes a first material and, optionally, a blend of a second material. For instance, in some implementations the band 102 of the bra 100 is formed using a first material (e.g., cotton) and one or more portions of the band (e.g., the underarm portions, the straps, the back portion, etc.) includes a blend of the first material and a second material (e.g., a blend of polyester and cotton).

In some implementations, one or more portions of the bra 100 is formed individually and combined with other portions of the bra to form the complete garment. For instance, in some implementations the underhand 112 and/or one or more straps 150 of the bra is formed individually and combined with other portions of the bra 100 to form a complete garment (e.g., sewn to the other portions of the bra, molded to the other portions of the bra, etc.). However, the present disclosure is not limited thereto. For instance, in some implementations the bra 100 is formed by a continuous, uninterrupted process (e.g., the bra is formed as a complete garment without needing to couple one or more portions of the bra together). Moreover, in some implementations, the band 102 of the bra 100 is formed by a continuous, uninterrupted process and one or more additional portions of the bra (e.g, the tessellated cups 120) are coupled to respective portions of the band 102 once the band is formed. To this point, in some implementations the bra 100 is formed utilizing a circular knitting machine. The circular knitting machine of the present disclosure includes a single knit machine and a double knit machine. In some implementations, the circular knitting machine is a SM4-TL2 single jersey circular knitting machine, which is provided by Santoni company of Via Carlo Fenzi, 14, 25135 Brescia, Italy. In some implementations, the circular knitting machine is a SM8-TOP2V circular knitting machine, a SM8-EVO4J circular knitting machine, a SM8-TR1 circular knitting machine, a SM-DJ2T circular knitting machine, a SM-DJ2TS circular knitting machine, or a SM-DJ circular knitting machine, each of which provided by the Santoni company. Forming the bra 100 through a continuous, uninterrupted process allows for the garment to be seamless, since each portion of the bra is integrally formed with other portions of the bra (e.g., the cup regions and the underarm portions are seamless formed). A seamless bra 100 improves comfort to a user by reducing a prepotency for chafing and/or discomfort to the user, as well as improving a lifespan of the bra since each seam of the bra may bear or be exposed to a high amount of stress and eventually deteriorate or tear.

Depending on both the implementation of the bra 100 and the component of the bra 100, in some implementations the Poisson's ratio is between −0.05 and −0.75. A more negative ratio (e.g., a ratio of −0.75 is more negative than a ratio of −0.10) yields a material that expands to a greater degree, and is associated with a more forgiving, looser dampening effect. For instance, in some implementations where movement of the breasts is less restrictive the Poisson's ratio of components of the bra 100 may be closer to zero. In other implementations where movement of the breasts is more restrictive the Poisson's ratio of components of the bra 100 may be closer to −1. In some implementations, the negative Poisson's ratio is between −0.05 and −0.25, between −0.05 and −0.5, between −0.05 and −0.95, between −0.25 and −0.5, between −0.25 and −0.75, between −0.40 and −0.65, between −0.30 and −0.85, or between −0.08 and −0.85. In some implementations, the auxetic material has a constant Poisson's ratio over deformation (e.g., the Poisson's ratio is a constant number when the material is exposed to both a small deformation and a large deformation). In some implementations, the auxetic material has a variable Poisson's ratio over deformation (e.g., the Poisson's ratio is variable over an exposure to a small deformation, a large deformation, or a transition there between).

In various implementations, the thermoformable polymeric foam is a polyurethane foam. In various implementations, the thermoformable polymeric foam is a closed-cell foam. Alternatively, in some implementations, the thermoformable polymeric foam is an open-cell foam. Open-cell foams refer to foams that have a majority of its cells "open" or exposed to one another, whereas closed-cell foam has a majority of its cells enclosed by its walls and are not interconnecting. Open cell foams are elastically deformable and soft, whereas closed-cell foams are harder are less deformable as compared to their open-celled counterparts. In some implementations, the open-cell foam is a reticulated open-cell polyurethane. Reticulated open-cell polyurethane foams are defined in part by their high porosity (e.g., pores per inch) and their low density. In some implementations, the reticulated open-cell polyurethane has between 20 and 100 pores in$^{-1}$ (ppi). In some implementations, the reticulated open-cell polyurethane has between 10 and 100 pores in$^{-1}$, between 10 and 80 pores in$^{-1}$, between 10 and 60 pores in$^{-1}$, between 20 and 60 pores in$^{-1}$, or between 40 and 60 pores in$^{-1}$. Moreover, in some implementations, the reticulated open-cell polyurethane has a density of 20-35 kg/m$^3$, a density of 26-32 kg/m$^3$, a density of 26-29 kg/m$^3$, or a density of 15-50 kg/m$^3$.

In some implementations, the auxetic foam is a 60 ppi closed-cell polyester urethane foam with a density of 37.9±2.1 kg/m$^3$. In some implementations, the auxetic foam is a 60 ppi reticulated polyester urethane foam with a density of 33.7±1.3 kg/m$^3$.

In some implementations, the auxetic foam is a 10 ppi open-cell polyether urethane foam with a density of 24.1±3.1 kg/m$^3$. In some implementations, the auxetic foam is a 30 ppi open-cell polyether urethane foam with a density of 24.5±2.7 kg/m$^3$. In some implementations, the auxetic foam is a 60 ppi open-cell polyether urethane foam with a density of 21.7±1.9 kg/m$^3$.

Figure 18:
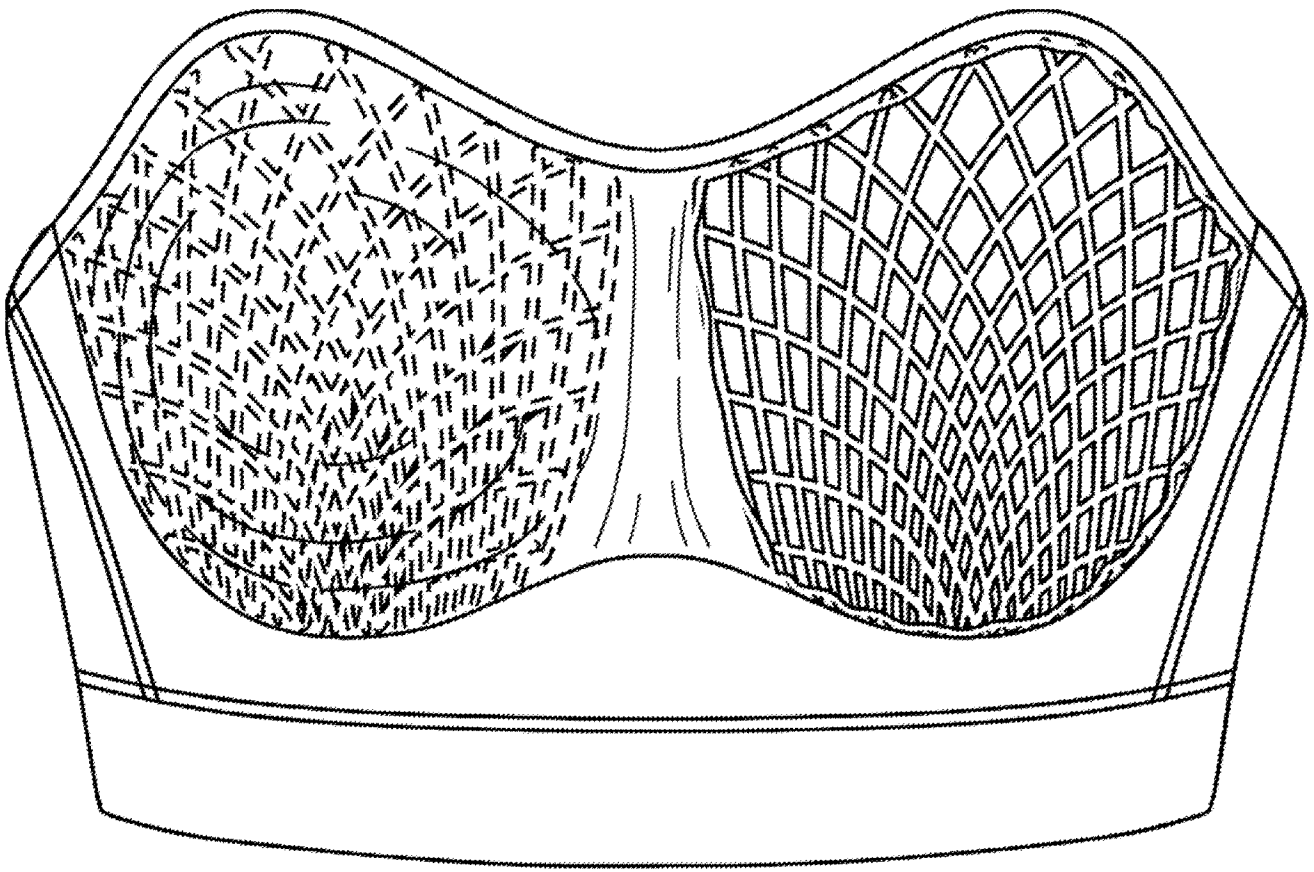
FIG. 18 illustrates a front view of another bra in accordance with an embodiment of the present disclosure.
Figure 19:
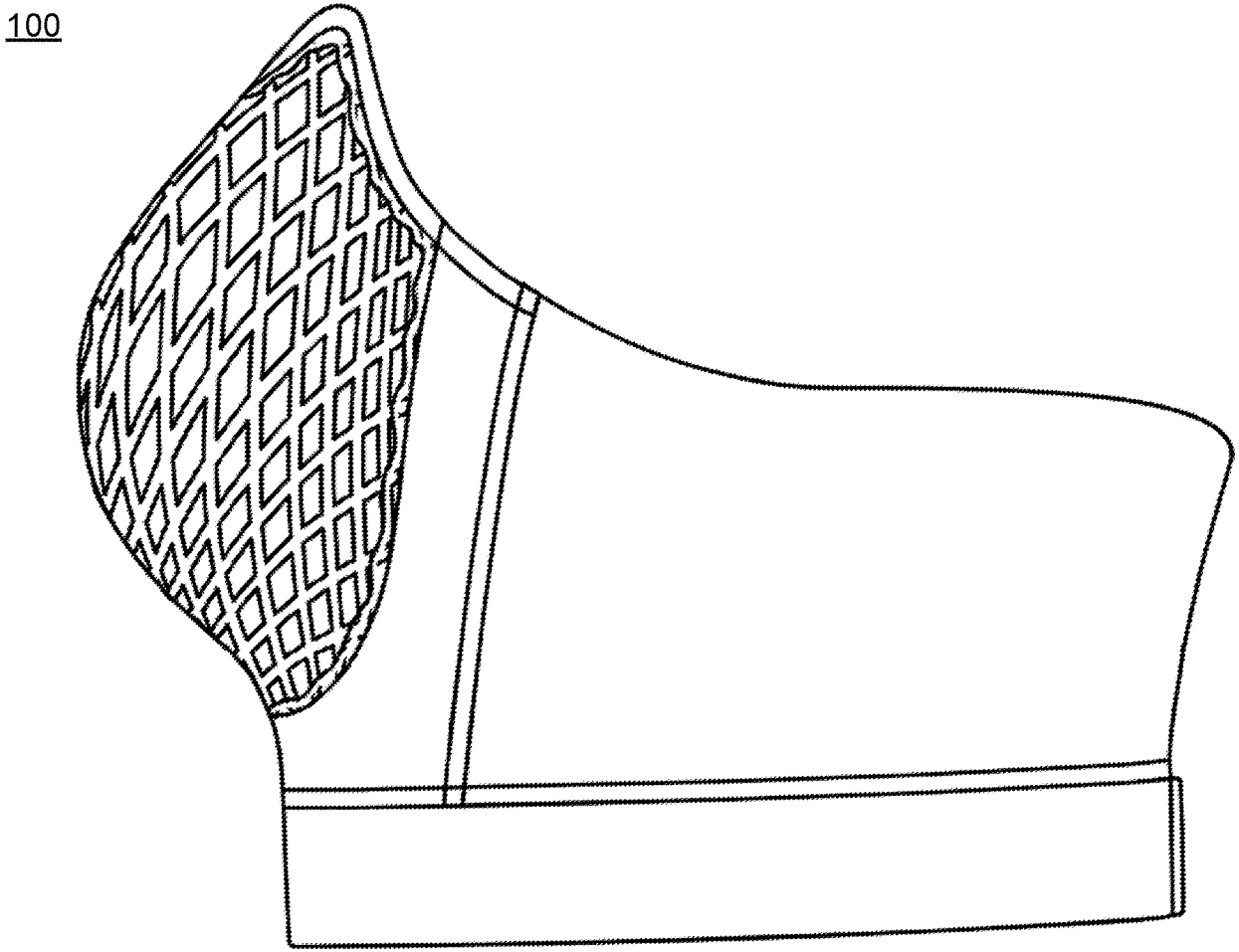
FIG. 19 illustrates a side view of the bra of FIG. 18.

Referring to FIGS. 18 and 19, a strapless bra 100 is illustrated in accordance with various implementations of the present disclosure.

Figure 20:
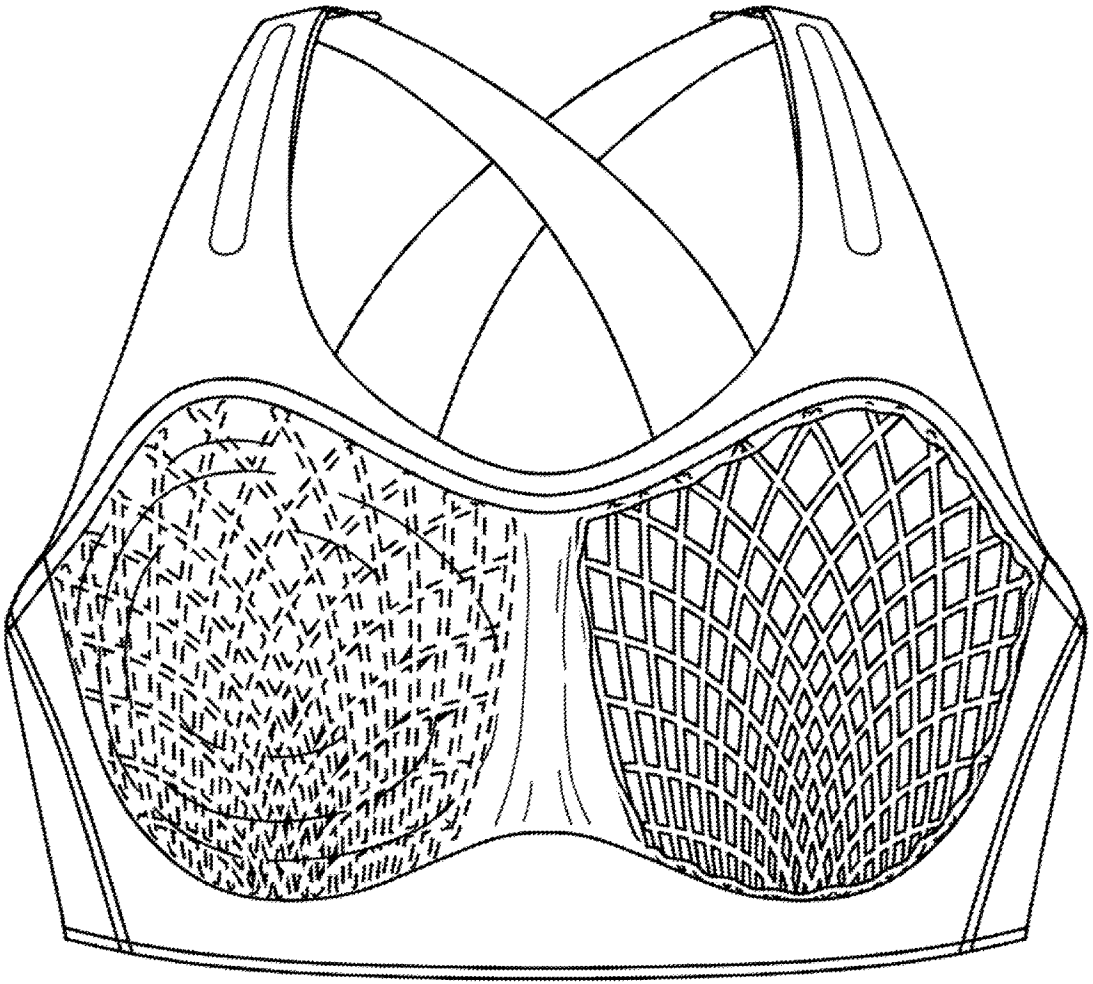
FIG. 20 illustrates a front view of yet another bra in accordance with an embodiment of the present disclosure.
Figure 21:
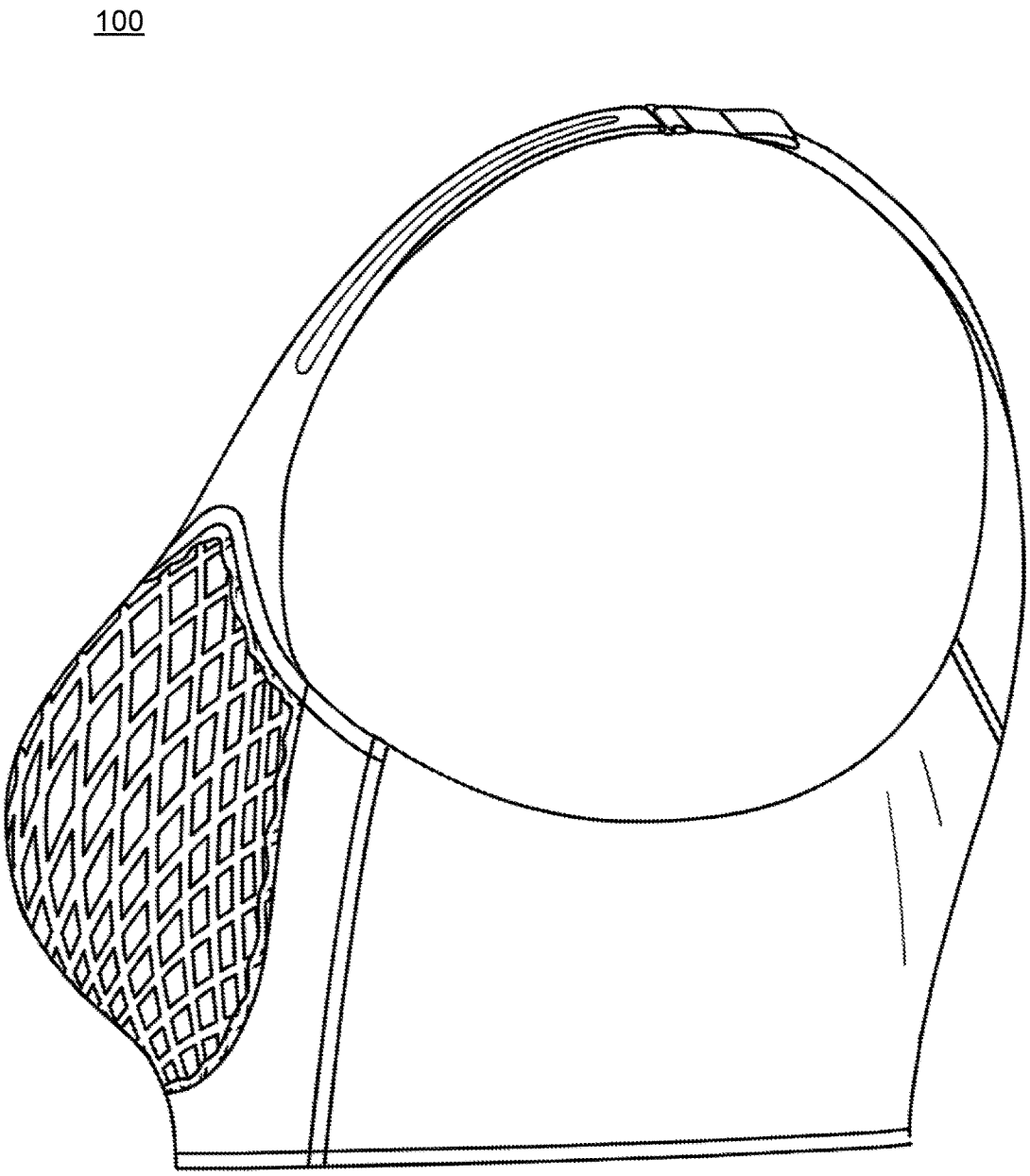
FIG. 21 illustrates a side view of the bra of FIG. 20.
Figure 22:
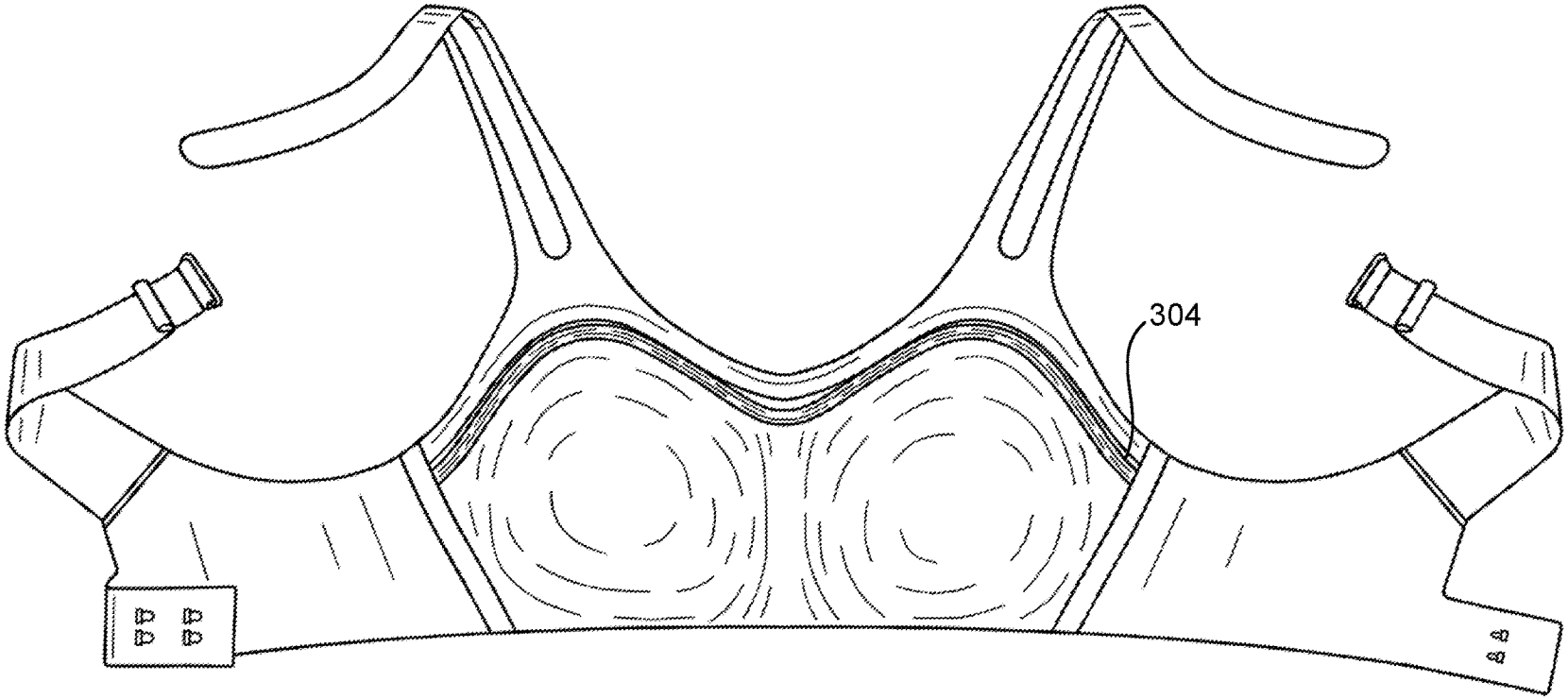
FIG. 22 illustrates a back portion of the bra of FIG. 20.

Referring to FIGS. 20 through 22, a bra which lacks an underhand is illustrated in accordance with various implementations of the present disclosure.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

What is claimed is:

1. A bra comprising:

a band configured to wrap around a torso, wherein the band comprises:
- a back portion,
- a first underarm portion,
- a second underarm portion, and
- a front portion,
- wherein the front portion is connected to the back portion through both the first underarm portion and the second underarm portion, and wherein the band comprises:
  - a first cup region, and
  - a second cup region; and
- a first tessellated encapsulating bra cup fitted into the first cup region, wherein
  - the first tessellated encapsulating bra cup comprises a first plurality of tiles,
  - respective tiles in the first plurality of tiles that are further away from a bottom portion of the band are larger in size than respective tiles in the first plurality of tiles that are closer to the bottom portion of the band, and
  - the first tessellated encapsulating bra cup has a generally concave first inner face and a generally convex first outer face; and
- a second tessellated encapsulating bra cup fitted into the second cup region,
- wherein
  - the second tessellated encapsulating bra cup comprises a second plurality of tiles,
  - respective tiles in the second plurality of tiles that are further away from the bottom portion of the band are larger in size than respective tiles in the second plurality of tiles that are closer to the bottom portion of the band, and the second tessellated encapsulating bra cup has a generally second concave inner face and a generally convex second outer face, and wherein the first tessellated encapsulating bra cup and the second tessellated encapsulating bra cup collectively contribute cantilevered support to the bra.

2. The bra of claim 1, wherein the bra is a pull-on bra.

3. The bra of claim 1, further comprising a channel running below the first cup region and the second cup region, the channel formed between an inner fabric and an outer fabric;

a gore above the channel and between the first cup region and the second cup region, the gore adjoining the first cup region and the second cup region; and a molded cradle fitted into the channel, wherein the molded cradle has a least a first curvature in a first plane.

4. The bra of claim 3, wherein the first cup region, the gore, and the second cup region collectively define a neckline on the front portion of the band.

5. The bra of claim 3, wherein respective tiles in the first plurality of tiles that are further away from the molded cradle are larger in size than respective tiles in the first plurality of tiles that are closer to the molded cradle; and respective tiles in the second plurality of tiles that are further away from the molded cradle are larger in size than respective tiles in the second plurality of tiles that are closer to the molded cradle.

6. The bra of claim 3, wherein the first tessellated encapsulating bra cup and the second tessellated encapsulating bra cup each comprise a compressible auxetic polymeric foam having a negative Poisson's ratio.

7. The bra of claim 6, wherein the compressible auxetic polymeric foam is formed by a compression and heat treatment process of a thermoformable polymeric foam.

8. The bra of claim 7, wherein the thermoformable polymeric foam is polyurethane foam.

9. The bra of claim 7, wherein the thermoformable polymeric foam is an open-cell foam.

10. The bra of claim 9, wherein the open-cell foam is a reticulated open-cell polyurethane.

11. The bra of claim 10, wherein the reticulated open-cell polyurethane has between 20 and 100 pores in-$^{1}$.

12. The bra of claim 10, wherein the reticulated open-cell polyurethane has a density of 20-35 kg/m$^{3}$.

13. The bra of claim 7, wherein the thermoformable polymeric foam is a closed-cell foam.

14. The bra of claim 6, wherein the negative Poisson's ratio is between −0.05 and −0.75.

15. The bra of claim 6, wherein the negative Poisson's ratio is between −0.05 and −0.25.

16. The bra of claim 3, wherein the first tessellated encapsulating bra cup, the second tessellated bra cup, and the gore form a single molded piece.

17. The bra of claim 3, wherein the first tessellated encapsulating bra cup forms a first molded piece and the second tessellated bra cup forms a second molded piece that is not molded to the first molded piece.

18. The bra of claim 3, wherein the first tessellated encapsulating bra cup, the second tessellated bra cup, the gore, and the molded cradle form a single molded piece.

19. The bra of claim 3, wherein the molded cradle comprises a thermoplastic elastomer.

20. The bra of claim 3, wherein the molded cradle comprises a second curvature in a second plane orthogonal to the first plane of the first curvature.

* * * * *